US008638946B1

(12) United States Patent
Mahabub

(10) Patent No.: US 8,638,946 B1
(45) Date of Patent: Jan. 28, 2014

(54) METHOD AND APPARATUS FOR CREATING SPATIALIZED SOUND

(75) Inventor: Jerry Mahabub, Highlands Ranch, CO (US)

(73) Assignee: GenAudio, Inc., Centennial, CO (US)

( * ) Notice: Subject to any disclaimer, the term of this patent is extended or adjusted under 35 U.S.C. 154(b) by 949 days.

(21) Appl. No.: 10/802,319

(22) Filed: Mar. 16, 2004

(51) Int. Cl.
*H04R 5/00* (2006.01)

(52) U.S. Cl.
USPC ..... 381/17; 381/1; 381/18

(58) Field of Classification Search
USPC ..... 381/61–63, 1–17, 23
See application file for complete search history.

(56) References Cited

U.S. PATENT DOCUMENTS

| | | | | |
|---|---|---|---|---|
| 5,500,900 | A * | 3/1996 | Chen et al. | 381/17 |
| 5,622,172 | A * | 4/1997 | Li et al. | 600/443 |
| 5,751,817 | A | 5/1998 | Brungart | |
| 5,802,180 | A * | 9/1998 | Abel et al. | 381/17 |
| 5,943,427 | A | 8/1999 | Massie et al. | |
| 6,118,875 | A | 9/2000 | Moller et al. | |
| 6,498,856 | B1 * | 12/2002 | Itabashi et al. | 381/302 |
| 6,990,205 | B1 * | 1/2006 | Chen | 381/17 |
| 7,116,788 | B1 * | 10/2006 | Chen et al. | 381/17 |
| 7,174,229 | B1 * | 2/2007 | Chen et al. | 700/94 |
| 7,590,249 | B2 * | 9/2009 | Jang et al. | 381/61 |
| 2004/0196994 | A1 | 10/2004 | Kates | |
| 2004/0247144 | A1 | 12/2004 | Nelson et al. | |
| 2005/0147261 | A1 * | 7/2005 | Yeh | 381/92 |
| 2005/0195995 | A1 | 9/2005 | Baumgarte | |
| 2007/0030982 | A1 | 2/2007 | Jones et al. | |

FOREIGN PATENT DOCUMENTS

WO WO2005/089360 9/2005

OTHER PUBLICATIONS

Bill Gardner and Keith Martin, "HRTF Measurements of a KEMAR Dummy-Head Microphone", MIT Media Lab-Technical Report #280. May 1994 p. 1-6.*

"General Solution of the Wave Equation", (Dec. 2002) www.silcom.com/~aludwig/Physics/Gensol/General_solution.html.*

Dmitry N. Zotkin et al, "Rendering localized Spatial Audio in a Virtual Auditory Space", IEEE Trans. on Multimedia, (2002) http://citeseer.ist.psu.edu/zotkin02rendering.html.*

EveryMac.com, "Apple Power Macintosh G5 2.0 DP(PCI-X) Specs (M9032LL/A)" 2003.*

Dmitry N. Zotkin et al, "Rendering localized Spatial Audio in a Virtual Auditory Space" http://hdl.handle.net/1903/1190.*

Author Unknown, The FIReverb Suite™ audio demonstration, http://www.catt.se/suite_music/, Copyright CATT 2000-2001, 5 pages.

(Continued)

*Primary Examiner* — Xue Mei
(74) *Attorney, Agent, or Firm* — Dorsey and Whitney LLP

(57) ABSTRACT

A method and apparatus for creating spatialized sound, including the operations of determining a spatial point in a spherical coordinate system, and applying an impulse response filter corresponding to the spatial point to a first segment of the audio waveform to yield a spatialized waveform. The spatialized waveform emulates the audio characteristics of a non-spatialized waveform emanating from the chosen spatial point. That is, when the spatialized waveform is played from a pair of speakers, the played sound apparently emanates from the chosen spatial point instead of the speakers. A finite impulse response filter may be employed to spatialize the audio waveform. The finite impulse response filter may be derived from a head-related transfer function modeled in spherical coordinates, rather than a typical Cartesian coordinate system. The spatialized audio waveform ignores speaker cross-talk effects, and requires no specialized decoders, processors, or software logic to recreate the spatialized sound.

26 Claims, 20 Drawing Sheets

(56) References Cited

OTHER PUBLICATIONS

Author Unknown, "Vivid Curve Loon Lake CD Recording Session", http://www.sonicstudios.com/vcloonlk.htm, Copyright 1999, 10 pages.

Author Unknown, "Wave Surround—Essential tools for sound processing", http://www.wavearts.com/WaveSurroundPro.html, Copyright 2004, 3 pages.

Li et al., "Recording and Rendering of Auditory Scenes through HRTF", University of Maryland, Perceptual Interfaces and Reality Lab and Neural Systems Lab, Date Unknown, 1 page.

Glasgal, Ralph, "Ambiophonics—Ambiofiles : Now you can have 360° PanAmbio surround", http://www.ambiophonics.org/Ambiofiles.htm, Date Unknown, 3 pages.

Miller III, Robert E. (Robin), "Audio Engineering Society: Convention Paper", Presented at the 112$^{th}$ Conventsion, May 10-13, 2002, Munich, Germany, 12 pages.

Author Unknown, "Cape Arago Lighthouse Pt. Foghorns, Birds, Wind, and Waves", http://www.sonicstudios.com/foghorn.htm, 5 pages, at least as early as Oct. 28, 2004.

Author Unknown, "Wave Field Synthesis: A brief overview", http://recherche.ircam.fr/equipes/salles/WFS_WEBSITE/Index_wfs_site.htm, 5 pages, at least as early as Oct. 28, 2004.

Glasgal, Ralph, "Ambiophonics—Testimonials", http://www.ambiophonics.org/testimonials.htm, 3 pages, at least as early as Oct. 28, 2004.

Tronchin et al., "The Calculation of the Impulse Response in the Binaural Technique", *Dienca-Ciarm, University of Bologna*, Bologna, Italy, 8 pages, date unknown.

Zotkin et al., "Rendering Localized Spatial Audio in a Virtual Auditory Space", *Perceptual Interfaces and Reality Laboratory, Institute for Advanced Computer Studies, University of Maryland*, College Park, Maryland, USA, 29 pages, 2002. (Abstract available at http://citeseer.ist.psu.edu/zotkin02rendering.html).

Webpage: "1999 IEEE Workshop on Applications of Signal Processing Audio and Acoustics", http://www.acoustics.hut.fi/waspaa99/program/accepted.html, Jul. 13, 1999.

* cited by examiner

— LEFT CHANNEL
- - - RIGHT CHANNEL

METHOD AND APPARATUS FOR CREATING SPATIALIZED SOUND

BACKGROUND OF THE INVENTION

1. Technical Field

This invention relates generally to sound engineering, and more specifically to methods and apparatuses for calculating and creating an audio waveform, which, when played through headphones, speakers, or another playback device, emulates at least one sound emanating from at least one spatial coordinate in three-dimensional space.

2. Background Art

Sounds emanate from various points in three-dimensional space. Humans hearing these sounds may employ a variety of aural cues to determine the spatial point from which the sounds originate. For example, the human brain quickly and effectively processes sound localization cues such as inter-aural time delays (i.e., the delay in time between a sound impacting each eardrum), sound pressure level differences between a listener's ears, phase shifts in the perception of a sound impacting the left and right ears, and so on to accurately identify the sound's origination point. Generally, "sound localization cues" refers to time and/or level differences between a listener's ears, as well as spectral information for an audio waveform.

The effectiveness of the human brain and auditory system in triangulating a sound's origin presents special challenges to audio engineers and others attempting to replicate and spatialize sound for playback across two or more speakers. Generally, past approaches have employed sophisticated pre- and post-processing of sounds, and may require specialized hardware such as decoder boards or logic. Good examples of these approaches include Dolby Labs' DOLBY audio processing, LOGIC7, Sony's SDDS processing and hardware, and so forth. While these approaches have achieved some degree of success, they are cost- and labor-intensive. Further, playback of processed audio typically requires relatively expensive audio components. Additionally, these approaches may not be suited for all types of audio, or all audio applications.

Accordingly, a novel approach to audio spatialization is required.

BRIEF SUMMARY OF THE INVENTION

Generally, one embodiment of the present invention takes the form of a method and apparatus for creating spatialized sound. In a broad aspect, an exemplary method for creating a spatialized sound by spatializing an audio waveform includes the operations of determining a spatial point in a spherical coordinate system, and applying an impulse response filter corresponding to the spatial point to a first segment of the audio waveform to yield a spatialized waveform. The spatialized waveform emulates the audio characteristics of the non-spatialized waveform emanating from the spatial point. That is, the phase, amplitude, inter-aural time delay, and so forth are such that, when the spatialized waveform is played from a pair of speakers, the sound appears to emanate from the chosen spatial point instead of the speakers.

In some embodiments, a finite impulse response filter may be employed to spatialize an audio waveform. Typically, the initial, non-spatialized audio waveform is a dichotic waveform, with the left and right channels generally (although not necessarily) being identical. The finite impulse response filter (or filters) used to spatialize sound are a digital representation of an associated head-related transfer function.

A head-related transfer function is a model of acoustic properties for a given spatial point, taking into account various boundary conditions. In the present embodiment, the head-related transfer function is calculated in a spherical coordinate system for the given spatial point. By using spherical coordinates, a more precise transfer function (and thus a more precise impulse response filter) may be created. This, in turn, permits more accurate audio spatialization.

Once the impulse response filter is calculated from the head-related transfer function, the filter may be optimized. One exemplary method for optimizing the impulse response filter is through zero-padding. To zero-pad the filter, the discrete Fourier transform of the filter is first taken. Next, a number of significant digits (typically zeros) are added to the end of the discrete Fourier transform, resulting in a padded transform. Finally, the inverse discrete Fourier transform of the padded transform is taken. The additional significant digits ensures the combination of discrete Fourier transform and inverse discrete Fourier transform do not reconstruct the original filter. Rather, the additional significant digits provide additional filter coefficients, which in turn provides a more accurate filter for audio spatialization.

As can be appreciated, the present embodiment may employ multiple head-related transfer functions, and thus multiple impulse response filters, to spatialize audio for a variety of spatial points. (As used herein, the terms "spatial point" and "spatial coordinate" are interchangeable.) Thus, the present embodiment may cause an audio waveform to emulate a variety of acoustic characteristics, thus seemingly emanating from different spatial points at different times. In order to provide a smooth transition between two spatial points and therefore a smooth three-dimensional audio experience, various spatialized waveforms may be convolved with one another.

The convolution process generally takes a first waveform emulating the acoustic properties of a first spatial point, and a second waveform emulating the acoustic properties of a second spatial point, and creates a "transition" audio segment therebetween. The transition audio segment, when played through two or more speakers, creates the illusion of sound moving between the first and second spatial points.

It should be noted that no specialized hardware or software, such as decoder boards or applications, or stereo equipment employing DOLBY or DTS processing equipment, is required to achieve full spatialization of audio in the present embodiment. Rather, the spatialized audio waveforms may be played by any audio system having two or more speakers, with or without logic processing or decoding, and a full range of three-dimensional spatialization achieved.

These and other advantages and features of the present invention will be apparent upon reading the following description and claims.

DETAILED DESCRIPTION OF THE INVENTION

1. Overview of the Invention

Figure 1:
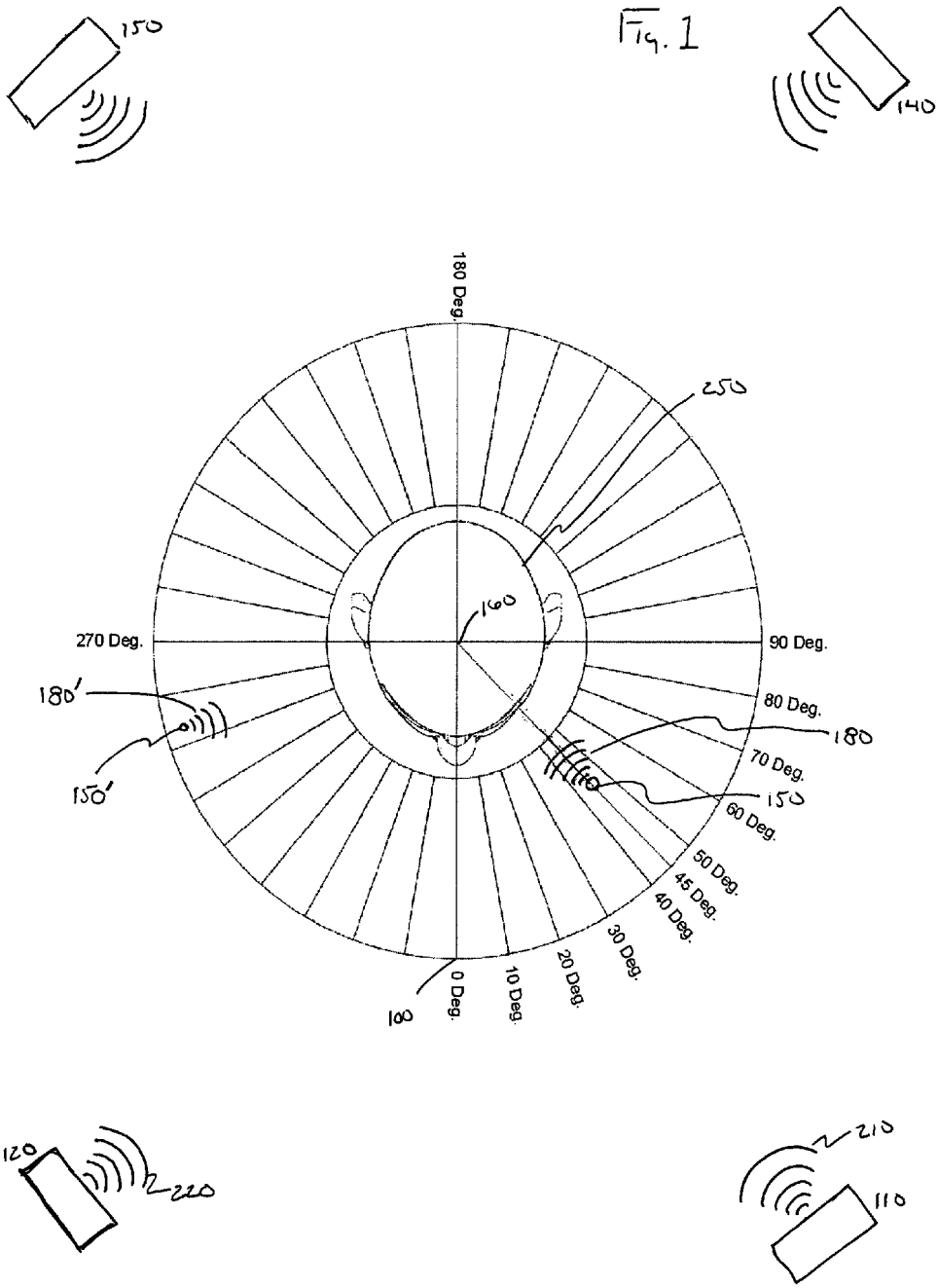
FIG. 1 depicts a top-down view of a listener occupying a "sweet spot" between four speakers, as well as an exemplary azimuthal coordinate system.

Generally, one embodiment of the present invention takes the form of a method for creating a spatialized sound waveform from a dichotic waveform. As used herein, "spatialized sound" refers to an audio waveform creating the illusion of audio emanating from a certain point in three-dimensional space. For example, two stereo speakers may be used to create a spatialized sound that appears to emanate from a point behind a listener facing the speakers, or to one side of the listener, even though the speakers are positioned in front of the listener. Thus, the spatialized sound produces an audio signature which, when heard by a listener, mimics a noise created at a spatial coordinate other than that actually producing the spatialized sound. Colloquially, this may be referred to as "three-dimensional sound," since the spatialized sound may appear to emanate from various points in three-dimensional space.

It should be understood that the term "three-dimensional space" refers only to the spatial coordinate or point from which sound appears to emulate. Such a coordinate is typically measured in three discrete dimensions. For example, in a standard Cartesian coordinate system, a point may be mapped by specifying X, Y, and Z coordinates. In a spherical coordinate system, r, theta, and phi coordinates may be used. Similarly, in a cylindrical coordinate system, coordinates r, z, and phi may be used.

Generally, however, audio spatialization may also be time-dependent. That is, the spatialization characteristics of a sound may vary depending on the particular portion of an audio waveform being spatialized. Similarly, as two or more audio segments are spatialized to emanate a sound moving from a first to a second spatial point, and so on, the relative time at which each audio segment occurs may affect the spatialization process. Accordingly, while "three-dimensional" may be used when discussing a single sound emanating from a single point in space, the term "four-dimensional" may be used when discussing a sound moving between points in space, multiple sounds at multiple spatial points, multiple sounds at a single spatial point, or any other condition in which time affects sound spatialization. In some instances as used herein, the terms "three-dimensional" and "four-dimensional" may be used interchangeably. Thus, unless specified otherwise, it should be understood that each term embraces the other.

Further, multiple spatialized waveforms may be mixed to create a single spatialized waveform, representing all individual spatialized waveforms. This "mixing" is typically performed through convolution, as described below. As the apparent position of a spatialized sound moves (i.e., as the spatialized waveform plays), the transition from a first spatial coordinate to a second spatial coordinate for the spatialized sound may be smoothed and/or interpolated, causing the spatialized sound to seamlessly transition between spatial coordinates. This process is described in more detail in the section entitled "Spatialization of Multiple Sounds," below.

Generally, the first step in sound spatialization is modeling a head related transfer function ("HRTF"). A HRTF may be thought of as a set of differential filter coefficients used to spatialize an audio waveform. The HRTF is produced by modeling a transfer route for sound from a specific point in space from which a sound emanates ("spatial point" or "spatial coordinate") to a listener's eardrum. Essentially, the HRTF models the boundary and initial conditions for a sound emanating from a given spatial coordinate, including a magnitude response at each ear for each angle of altitude and azimuth, as well as the inter-aural time delay between the sound wave impacting each ear. As used herein, "altitude" may be freely interchanged with "elevation."

The HRTF may take into account various physiological factors, such as reflections or echoes within the pinna of an ear or distortions caused by the pinna's irregular shape, sound reflection from a listener's shoulders and/or torso, distance between a listener's eardrums, and so forth. The HRTF may incorporate such factors to yield a more faithful or accurate reproduction of a spatialized sound.

An impulse response filter (generally finite, but infinite in alternate embodiments) may be created or calculated to emulate the spatial properties of the HRTF. Creation of the impulse response filter is discussed in more detail below. In short, however, the impulse response filter is a numerical/digital representation of the HRTF.

A stereo waveform may be transformed by applying the impulse response filter, or an approximation thereof, through the present method to create a spatialized waveform. Each point (or every point separated by a time interval) on the stereo waveform is effectively mapped to a spatial coordinate from which the corresponding sound will emanate. The stereo waveform may be sampled and subjected to a finite impulse response filter ("FIR"), which approximates the aforementioned HRTF. For reference, a FIR is a type of digital signal filter, in which every output sample equals the weighted sum of past and current samples of input, using only some finite number of past samples.

The FIR, or its coefficients, generally modifies the waveform to replicate the spatialized sound. As the coefficients of a FIR are defined, they may be (and typically are) applied to additional dichotic waveforms (either stereo or mono) to spatialize sound for those waveforms, skipping the intermediate step of generating the FIR every time.

The present embodiment may replicate a sound in three-dimensional space, within a certain margin of error, or delta. Typically, the present embodiment employs a delta of five inches radius, two degrees altitude (or elevation), and two degrees azimuth, all measured from the desired spatial point. In other words, given a specific point in space, the present embodiment may replicate a sound emanating from that point to within five inches offset, and two degrees vertical or horizontal "tilt." Effectively, the present embodiment employs spherical coordinates to measure the location of the spatialization point. It should be noted that the spatialization point in question is relative to the listener. That is, the center of the listener's head corresponds to the origin point of the spherical coordinate system. Thus, the various error margins given above are with respect to the listener's perception of the spatialized point.

Alternate embodiments may replicate spatialized sound even more precisely by employing finer FIRs. Alternate embodiments may also employ different FIRs for the same spatial point in order to emulate the acoustic properties of different settings or playback areas. For example, one FIR may spatialize audio for a given spatial point while simultaneously emulating the echoing effect of a concert hall, while a second FIR may spatialize audio for the same spatial point but simultaneously emulate the "warmer" sound of a small room or recording studio.

When a spatialized waveform transitions between multiple spatial coordinates (typically to replicate a sound "moving" in space), the transition between spatial coordinates may be smoothed to create a more realistic, accurate experience. In other words, the spatialized waveform may be manipulated to cause the spatialized sound to apparently smoothly transition from one spatial coordinate to another, rather than abruptly changing between discontinuous points in space. In the present embodiment, the spatialized waveform may be convolved from a first spatial coordinate to a second spatial coordinate, within a free field, independent of direction, and/or diffuse field binaural environment. The convolution techniques employed to smooth the transition of a spatialized sound (and, accordingly, modify/smooth the spatialized waveform) are discussed in greater detail below.

In short, the present embodiment may create a variety of FIRs approximating a number of HRTFs, any of which may be employed to emulate three-dimensional sounds from a dichotic waveform.

2. Spherical Coordinate Systems

Generally, the present embodiment employs a spherical coordinate system (i.e., a coordinate system having radius r, altitude $\theta$, and azimuth $\phi$ as coordinates), rather than a standard Cartesian coordinate system. The spherical coordinates are used for mapping the simulated spatial point, as well as calculation of the FIR coefficients (described in more detail below), convolution between two spatial points, and substantially all calculations described herein. Generally, by employing a spherical coordinate system, accuracy of the FIRs (and thus spatial accuracy of the waveform during playback) is increased. A spherical coordinate system is well-suited to solving for harmonics of a sound propagating through a medium, which are typically expressed as Bessel functions. Bessel functions, for example, are unique to spherical coordinate systems, and may not be expressed in Cartesian coordinate systems. Accordingly, certain advantages, such as increased accuracy and precision, may be achieved when various spatialization operations are carried out with reference to a spherical coordinate system.

Additionally, the use of spherical coordinates has been found to minimize processing time required to create the FIRs and convolve spatial audio between spatial points, as well as other processing operations described herein. Since sound/audio waves generally travel through a medium as a spherical wave, spherical coordinate systems are well-suited to model sound wave behavior, and thus spatialize sound. Alternate embodiments may employ different coordinate systems, including a Cartesian coordinate system.

Figure 2:
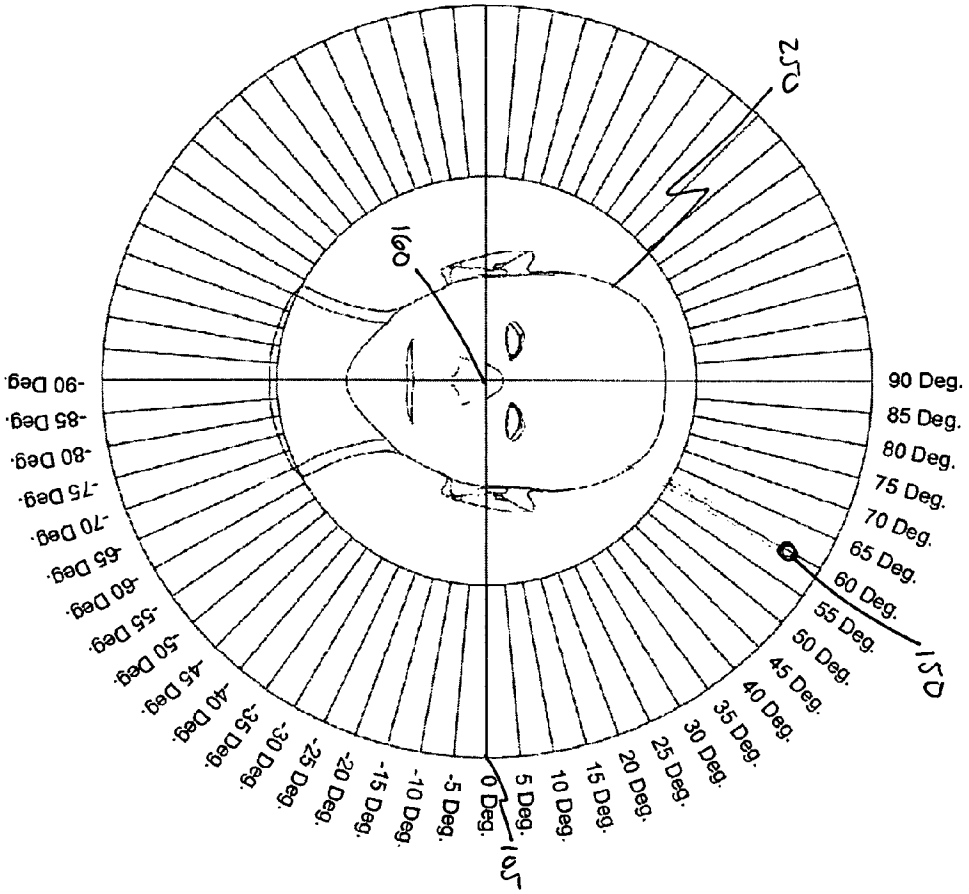
FIG. 2 depicts a front view of the listener shown in FIG. 1, as well as an exemplary latitudinal coordinate system.
Figure 3:
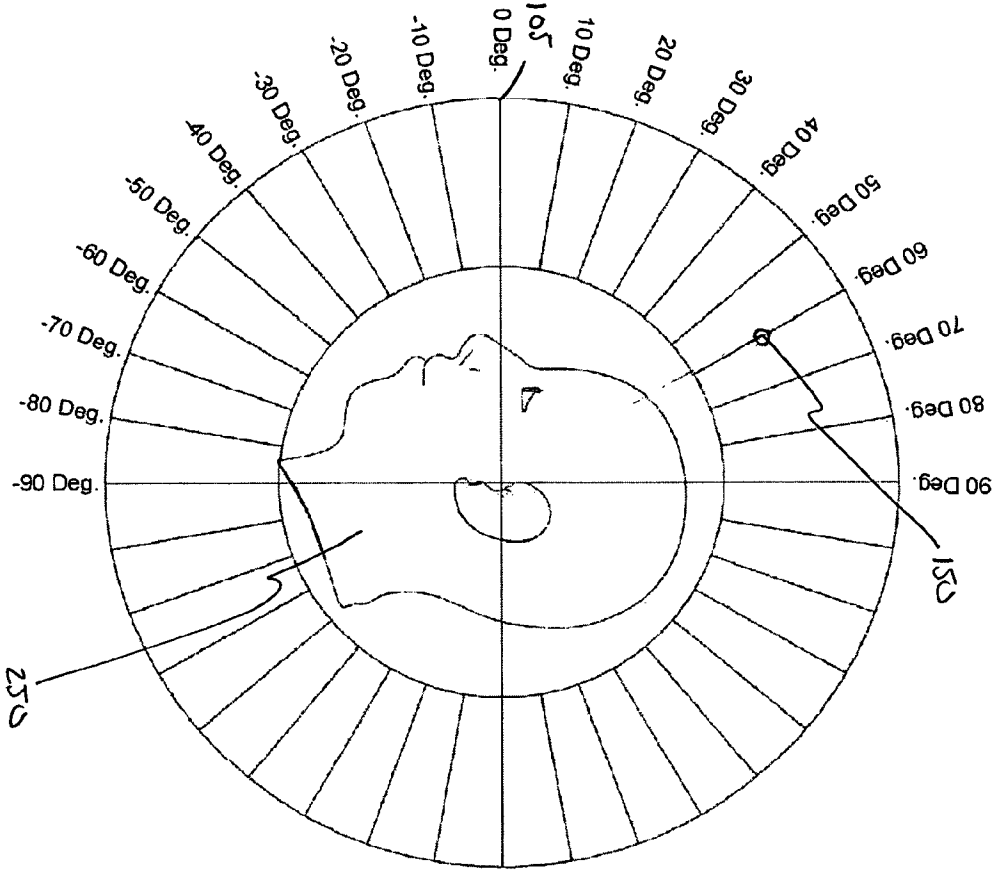
FIG. 3 depicts a side view of the listener shown in FIG. 1, as well as the exemplary latitudinal coordinate system of FIG. 2.
Figure 4:
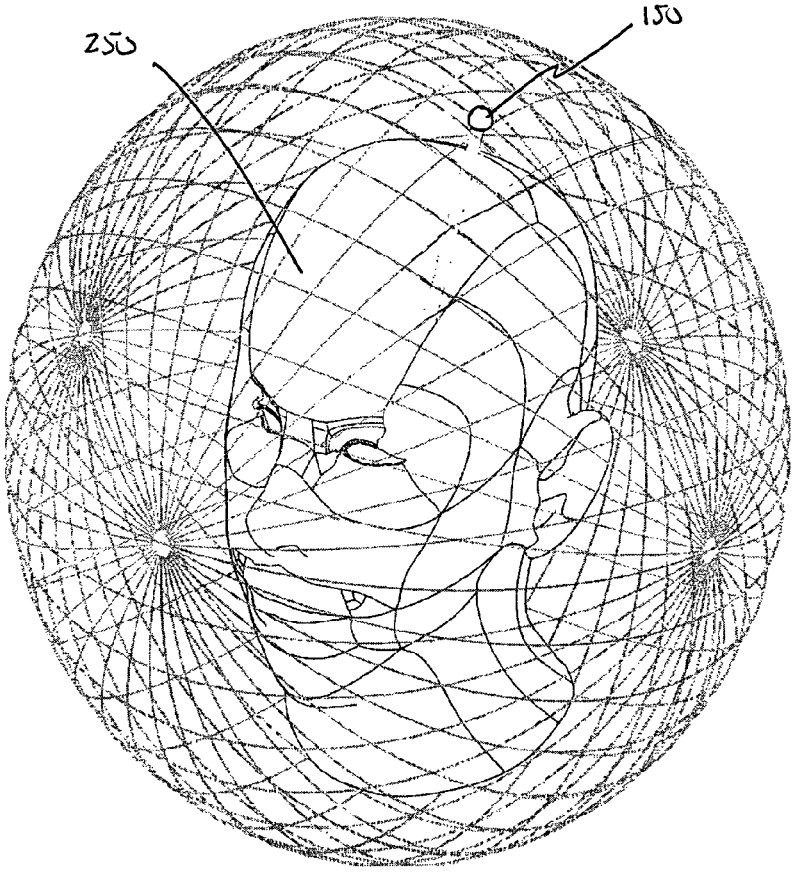
FIG. 4 depicts a three-dimensional view of the listener of FIG. 1, as well as an exemplary spatial coordinate measured by the spherical coordinates.

In the present document, a specific spherical coordinate convention is employed. Zero azimuth 100, zero altitude 105, and a non-zero radius of sufficient length correspond to a point in front of the center of a listener's head, as shown in FIGS. 1 and 3, respectively. As previously mentioned, the terms "altitude" and "elevation" are generally interchangeable herein. Azimuth increases in a counter-clockwise direction, with 180 degrees being directly behind the listener. Azimuth ranges from 0 to 359 degrees. Similarly, altitude may range from 90 degrees (directly above a listener's head) to −90 degrees (directly below a listener's head), as shown in FIG. 2. FIG. 3 depicts a side view of the altitude coordinate system used herein.

It should be noted the coordinate system also presumes a listener faces a main, or front, pair of speakers 110, 120. Thus, as shown in FIG. 1, the azimuthal hemisphere corresponding to the front speakers' emplacement ranges from 0 to 90 degrees and 270 to 359 degrees, while the azimuthal hemisphere corresponding to the rear speakers' emplacement ranges from 90 to 270 degrees. In the event the listener changes his rotational alignment with respect to the front speakers 110, 120, the coordinate system does not vary. In other words, azimuth and altitude are speaker dependent, and listener independent. It should be noted that the reference coordinate system is listener dependent when spatialized audio is played back across headphones worn by the listener, insofar as the headphones move with the listener. However, for purposes of the discussion herein, it is presumed the listener remains relatively centered between, and equidistant from, a pair of front speakers 110, 120. Rear speakers 130, 140 are optional. The origin point 160 of the coordinate system corresponds approximately to the center of a listener's head, or the "sweet spot" in the speaker set up of FIG. 1. It should be noted, however, that any spherical coordinate notation may be employed with the present embodiment. The present notation is provided for convenience only, rather than as a limitation.

3. Exemplary Spatial Point and Waveform

In order to provide an example of spatialization by the present invention, an exemplary spatial point 150 and dichotic spatialized waveform 170 are provided. The spatial point 150 and waveform (both spatialized 170 and non-spatialized 180) are used throughout this document, where necessary, to provide examples of the various processes, methods, and apparatuses used to spatialize audio. Accordingly, examples are given throughout of spatializing an audio waveform 180 emanating from a spatial coordinate 150 of elevation (or altitude) 60 degrees, azimuth 45 degrees, and fixed radius. Where necessary, reference is also made to a second arbitrary spatial point 150'. These points are shown on FIGS. 1-4.

Figure 5:
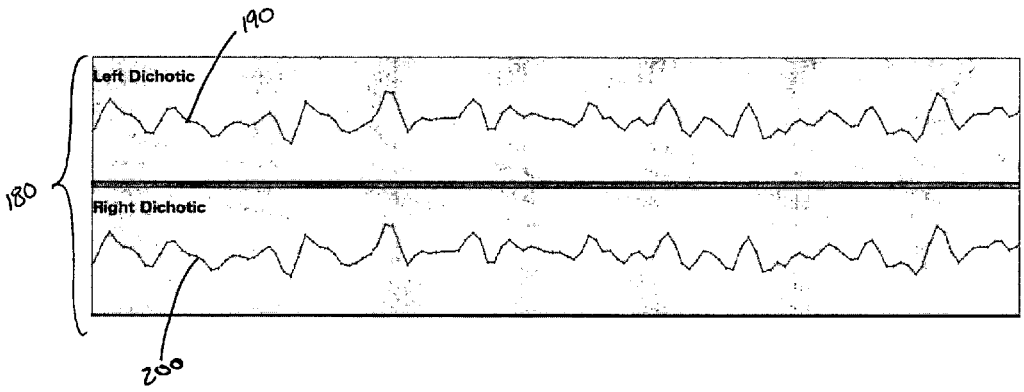
FIG. 5 depicts left and right channels of an exemplary dichotic waveform.

An exemplary, pre-spatialized dichotic waveform 180 is shown in FIG. 5. FIG. 5 depicts both the left channel dichotic waveform 190 and right channel dichotic waveform 200. Since the left 190 and right 200 waveforms were initially created from a monaural waveform, they are substantially identical, with little or no phase shift. FIG. 1 depicts the pre-spatialized waveform 180 emanating from the spatial point 150, and a second pre-spatialized waveform emanating from the second spatial point 150'.

Figure 6:
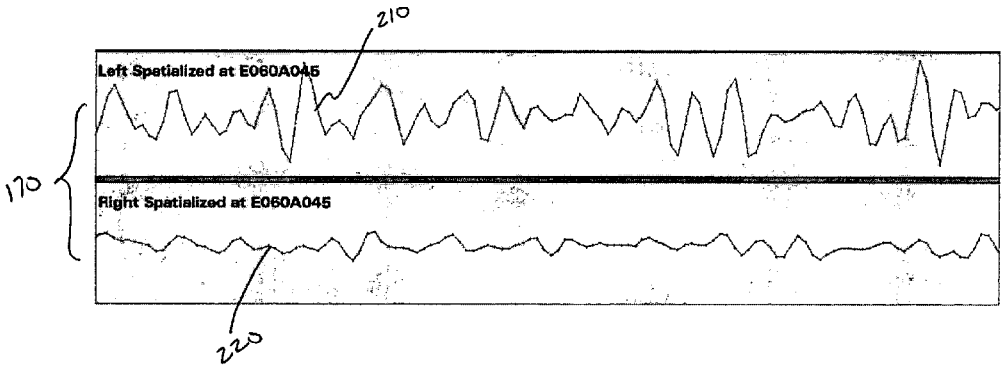
FIG. 6 depicts left and right channels of an exemplary spatialized waveform, corresponding to the waveform of FIG. 5.

FIG. 6 depicts the dichotic waveform 180 of FIG. 5, after being spatialized to emulate sound emanating from the aforementioned exemplary spatial point. The left dichotic waveform 210, spatialized to correspond to the left channel waveform 190 shown in FIG. 5 emanating from a spatial point 150 with elevation 60 degrees, azimuth 45 degrees, is different in several respects from the pre-spatialized waveform. For example, the spatialized waveform's 210 amplitude, phase, magnitude, frequency, and other characteristics have been altered by the spatialization process. The same is true for the right dichotic waveform 220 after spatialization, also shown in FIG. 6. Typically (although not necessarily), the spatialized left dichotic channel 210 is played by a left speaker 110, while the spatialized right dichotic channel 220 is played by a right speaker 120. This is shown in FIG. 1.

Due to the emulated inter-aural time delay, the spatialization process affects the left 190 and right 200 dichotic waveforms differently. This may be seen by comparing the two spatialized waveform channels 210, 220 shown in FIG. 6.

It should be understood that the processes, methods, and apparatuses disclosed herein operate for a variety of spatial points and on a variety of waveforms. Accordingly, the exemplary spatial point 150 and exemplary waveforms 170, 180 are provided only for illustrative purposes, and should not be considered limiting.

4. Operational Overview

Figure 7:
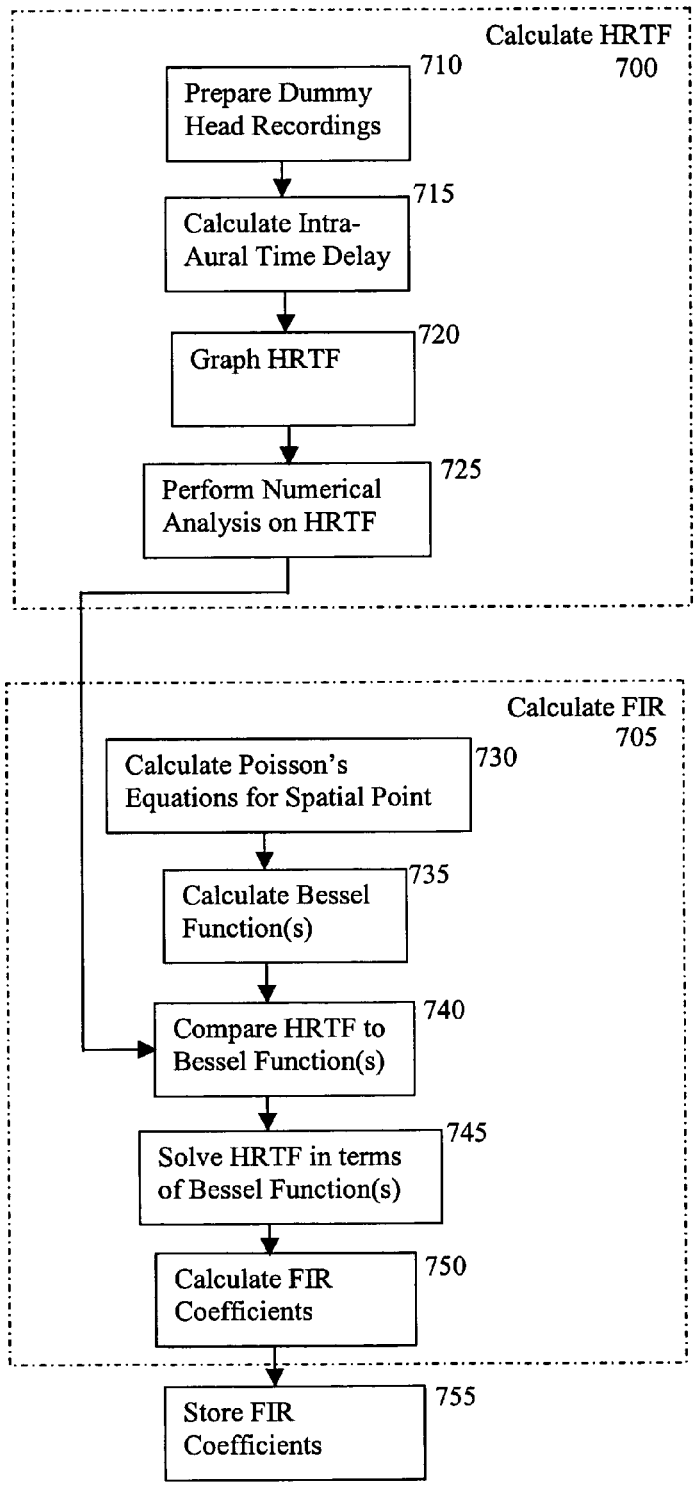
FIG. 7 is a flowchart of an operational overview of the present embodiment.

Generally, the process of spatializing sound may be broken down into multiple discrete operations. The high-level operations employed by the present embodiment are shown in FIG. 7. The process may be thought of as two separate sub-processes, each of which contains specific operations. Some or all of these operations (or sub-processes) may be omitted or modified in certain embodiments of the present invention. Accordingly, it should be understood that the following is exemplary, rather than limiting.

The first sub-process 700 is to calculate a head-related transfer function for a specific spatial point 150. Each spatial point 150 may have its own HRTF, insofar as the sound wave 180 emanating from the point impacts the head differently than a sound wave emanating from a different spatial point. The reflection and/or absorption of sound from shoulders, chest, facial features, pinna, and so forth all varies depending on the location of the spatial point 150 relative to a listener's ears. While the sound reflection may also vary due to physiological differences between listeners, such variations are relatively minimal and need not be modeled. Accordingly, a single model is used for all HRTFs for a given point 150. It should be noted that spatial points near in space may share certain superficially similar physical qualities, such as air temperature, proximity to the head, and so forth. However, the variances encountered by sound waves 180 emanating from two discrete spatial points are such that each spatial point 150 essentially represents a discrete set of boundary and/or initial conditions. Accordingly, a unique HRTF is typically generated for each such point. In some embodiments, similarities between a first spatial point 150 and a second, nearby spatial point may be used to estimate or extrapolate the second point's HRTF from the first point's HRTF.

In the first operation 710 of the HRTF calculation sub-process 700, dummy head recordings are prepared. An approximation of a human head is created from polymer, foam, wood, plastic, or any other suitable material. One microphone is placed at the approximate location of each ear. The microphones measure sound pressure caused by the sound wave 180 emanating from the spatial point 150, and relay this measurement to a computer or other monitoring device. Typically, the microphones relay data substantially instantly upon receiving the sound wave.

Next, the inter-aural time delay is calculated in operation 715. The monitoring device not only records the measured data, but also the delay between the sound wave impacting the first and second microphones. This delay is approximately equivalent to the delay between a sound wave 180 emanating from the same relative point 150 impacting a listener's left and right eardrums (or vice versa), referred to as the "inter-aural time delay." Thus, the monitoring device may construct the inter-aural time delay from the microphone data. The inter-aural time delay is used as a localization cue by listeners to pinpoint sound. Accordingly, mimicking the inter-aural time delay by phase shifting one of a left 190 or right 200 channel of a waveform 180 emanating from one or more speakers 110, 120, 140, 150 proves useful when spatializing sound.

Figure 9A:
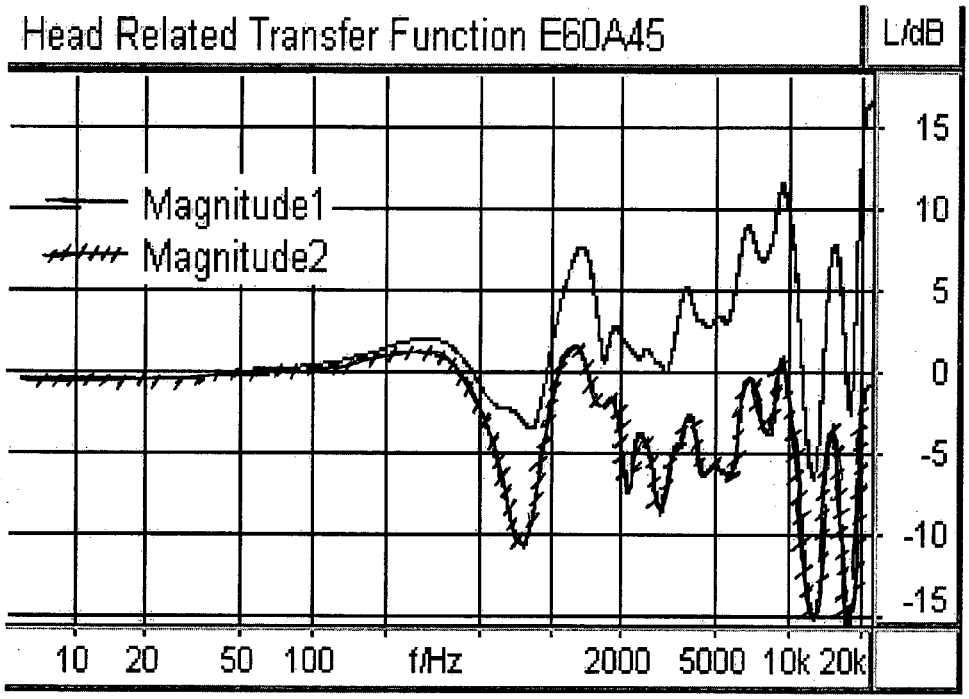
FIG. 9A depicts an exemplary head-related transfer function graphed in terms of frequency vs. decibel level, showing magnitude for left and right channels.
Figure 9B:
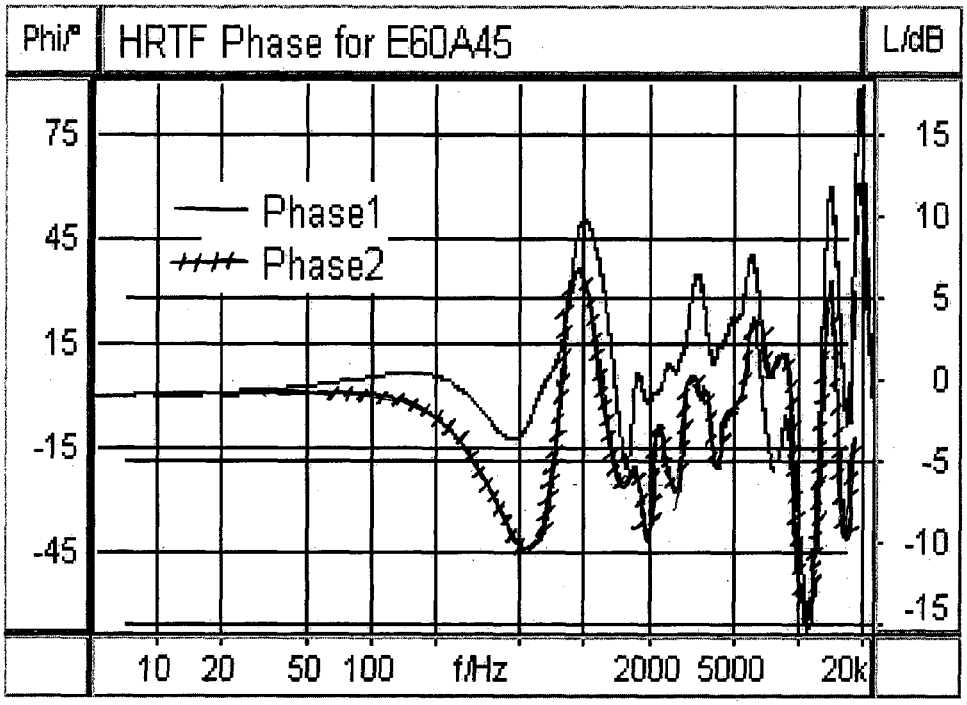
FIG. 9B depicts an exemplary head-related transfer function graphed in terms of frequency vs. decibel level, showing phase for left and right channels.
Figure 10A:
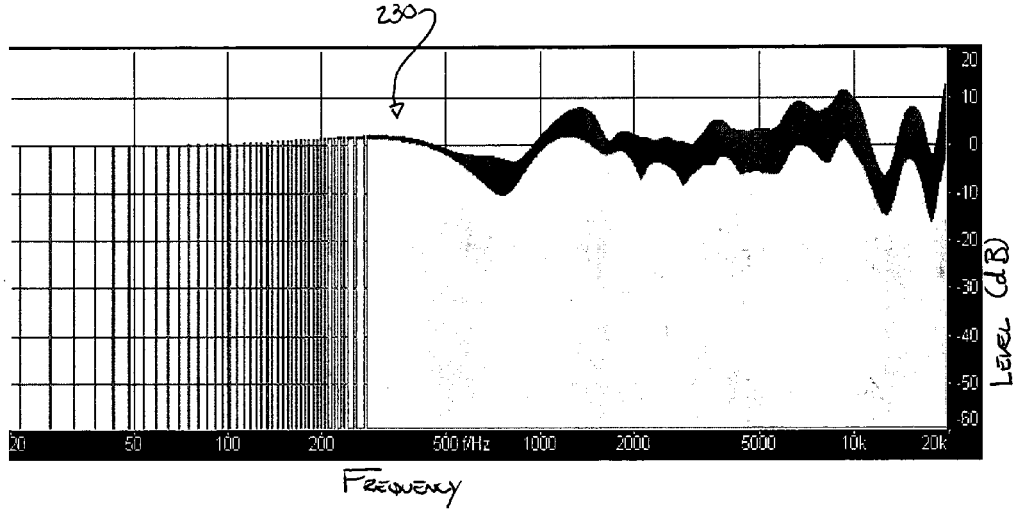
FIG. 10A depicts a second view of the exemplary head-related transfer function graphed in FIG. 9A.

Once the measurements are taken, the HRTF may be graphed in operation 720. The graph is a two-dimensional representation of the three-dimensional HRTF for the spatial point 150, and is typically generated in a spherical coordinate system. The HRTF may be displayed, for example, as a sound pressure level (typically measure in dB) vs. frequency graph, a magnitude vs. time graph, a magnitude vs. phase graph, a magnitude vs. spectra graph, a fast Fourier transform vs. time graph, or any other graph placing any of the properties mentioned herein along an axis. Generally, a HRTF models not only the magnitude response at each ear for a sound wave emanating from a specific altitude, azimuth, and radius (i.e., a spatial point 150), but also the inter-aural time delay. Graphing the HRTF yields a general solution for each point on the graph. FIGS. 9A and 9B, for example, depict the HRTF for the exemplary waveform 180 (i.e., the dichotic waveform shown in FIG. 5) emanating from the exemplary spatial point 150 (i.e., azimuth 60 degrees, altitude 45 degrees). Magnitude for the left 190 and right 200 dichotic waveforms is shown in FIG. 9A, while phase for both waveforms is shown in FIG. 9B. Similarly, FIG. 10A depicts an expanded view of the HRTF 230 for the exemplary point 150 and exemplary waveform channels 190, 200 as a graph of sound pressure (in decibels, or dB) versus frequency (measured in Hertz, or Hz) for each channel.

Figure 10B:
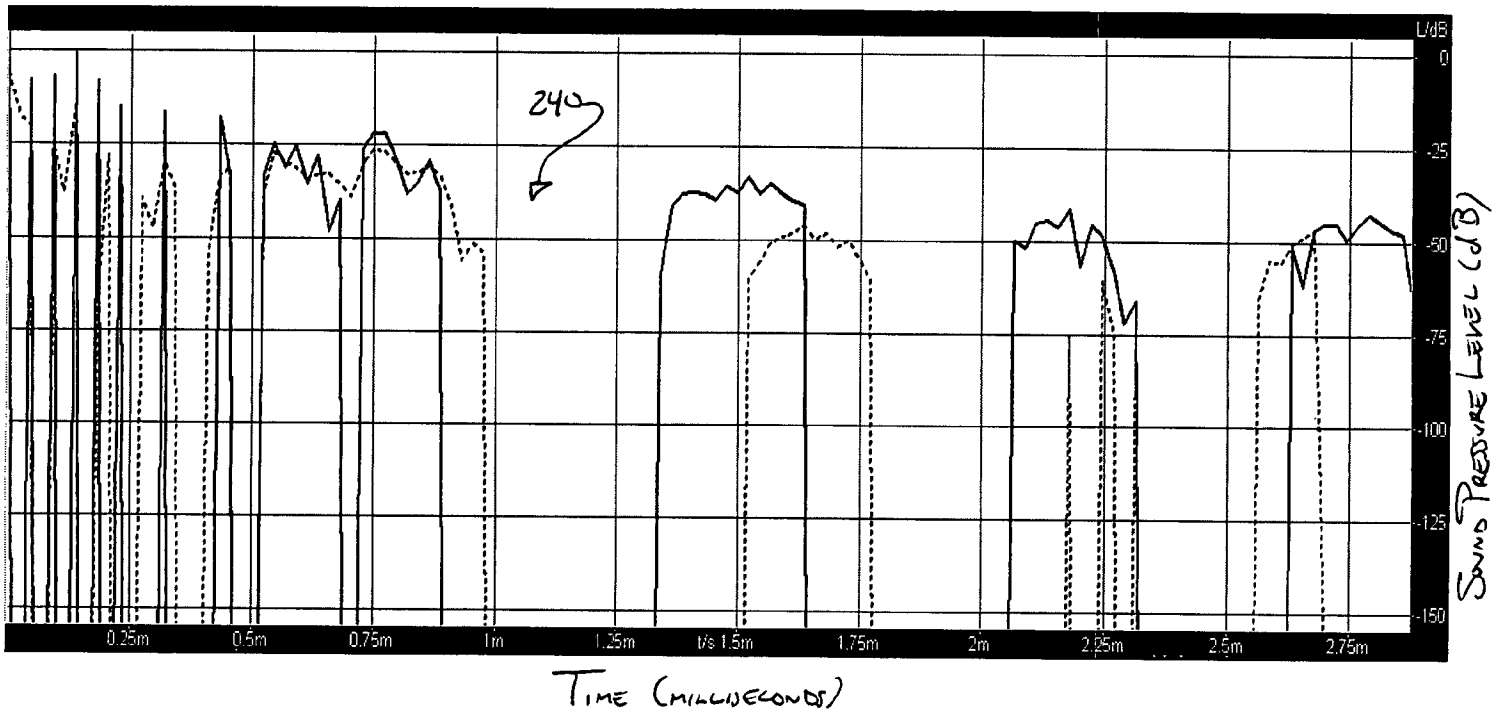
FIG. 10B depicts an impulse response filter corresponding to the exemplary head-related transfer function of FIG. 10A.

Once graphed, the HRTF 230 is subjected to numerical analysis in operation 725. Typically, the analysis is either finite element or finite difference analysis. This analysis generally reduces the HRTF 230 to a FIR 240, as described in more detail below in the second sub-process (i.e., the "Calculate FIR" sub-process 705) and shown in FIG. 10B. FIG. 10B depicts the FIR 240 for the exemplary spatial point 150 (i.e., elevation 60 degrees, azimuth 45 degrees) in terms of time (in milliseconds) versus sound pressure level (in decibels) for both left and right channels. It should be noted both the HRTF 230 and FIR 240 shown in FIGS. 10A and 10B and described herein are exemplary, and not limiting. The FIR 240 is a numerical representation of the HRTF 230 graph, used to digitally process an audio signal 180 to reproduce or mimic the particular physiological characteristics necessary to convince a listener that a sound emanates from the chosen spatial point 150. These characteristics typically include the inter-aural delay mentioned above, as well as the altitude 105 and azimuth 100 of the spatial point.

Since the FIR 240 is generated from numerical analysis of a spherical graph of the HRTF 230 in the second sub-process 705, the FIR typically is defined by spherical coordinates as well. The FIR is generally defined in the following manner.

First, in operation 730 Poisson's equation may be calculated for the given spatial point 150. Poisson's equation is generally solved for pressure and velocity in most models employed by the present embodiment. Further, in order to mirror the HRTF constructed previously, Poisson's equation is solved using a spherical coordinate system.

Poisson's formula may be calculated in terms of both sound pressure and sound velocity in the present embodiment. Poisson's formula is used, for example, in the calculation of HRTFs 230. A general solution of Poisson's formula, as used to calculate HRTFs employing spherical coordinates, follows. It should be noted that the use of Poisson's formula by the present embodiment permits the calculation of accurate HRTFs 230, insofar as the HRTF models a spherical space, and thus permits more accurate spatialization.

Poisson's equation may be expressed, in terms of pressure, as follows:

$$p(R_p) = \frac{jk}{4\pi}\int_S \frac{e^{-jk\rho}}{\rho}\left\{p(r)\left[\frac{1+jk\rho}{jk\rho}\right]a_r - Z_0 u(r)\right\}\cdot n d\vec{S}$$

Here, $p(R_p)$ is the sound pressure along a vector from the origin 160 of a sphere to some other point within the sphere (typically, the point 150 being spatialized). U represents the velocity of the sound wave along the vector. p is the density of air, and k equals the pressure wave constant. A similar derivation may express a sound wave's velocity in terms of pressure. The sound wave referred to herein is the audio waveform spatialized by the present embodiment, which may be the exemplary audio waveform 180 shown in FIG. 5 or any other waveform. Similarly, the spatial point referenced herein is the exemplary point 150 shown in FIGS. 1-4, but any other spatial point may serve equally well as the basis for spatialization.

It should be noted that both the pressure p and the velocity u must be known on the boundary for the above expression of Poisson's equation. By solving Poisson's equation for both pressure and velocity, more accurate spatialization may be obtained.

The solution of Poisson's equation, when employing a spherical coordinate system, yields one or more Bessel functions in operation 735. The Bessel functions represent spherical harmonics for the spatial point 150. More specifically, the Bessel functions represent Hankel functions of all orders for the given spatial point 150. These spherical harmonics vary with the values of the spatial point 150 (i.e., r, theta, and phi), as well as the time at which a sound 180 emanates from the point 150 (i.e., the point on the harmonic wave corresponding to the time of emanation). It should be noted that Bessel functions are generally unavailable when Poisson's equation is solved in a Cartesian coordinate system, insofar as Bessel functions definitionally require the use of a spherical coordinate system. The Bessel functions describe the propagation of sound waves 180 from the spatial point 150, through the transmission medium (typically atmosphere), reflectance off any surfaces mapped by the HRTF 230, the listener's head 250 (or dummy head) acting as a boundary, sound wave impact on the ear, and so forth.

Once the Bessel functions are calculated in operation 735 and the HRTF 230 numerically analyzed in operation 725, they may be compared to one another to find like terms in operation 740. Essentially, the Bessel function may be "solved" as a solution in terms of the HRTF 230, or vice versa, in operation 745. Reducing the HRTF 230 to a solution of the Bessel function (or, again, vice versa) yields the general form of the impulse response filter 240. The filter's coefficients may be determined from the general form of the impulse response filter 240 in operation 750. The impulse response filter is typically a finite impulse response, but may alternately be an infinite impulse response filter. The filter 240 may then be digitally represented by a number of taps, or otherwise digitized in embodiments employing a computer system to spatialize sound. Some embodiments may alternately define and store the FIR 240 as a table having entries corresponding to the FIR's frequency steps and amplification levels, in decibels, for each frequency step. Regardless of the method of representation, once created and digitized, the FIR 240 and related coefficients may be used to spatialize sound. FIG. 10B depicts the impulse response 240 for the exemplary spatial point, corresponding to the HRTF 230 shown in FIG. 10A. In other words, the impulse response filter 240 shown in FIG. 10B is the digital representation of the HRTF 230 shown in FIG. 10A. It should be noted the impulse response is waveform independent. That is, the impulse response 240 depends solely on the spatial point 150, and not on the waveform 180 emanating from the spatial point.

Optionally, the FIR's 240 coefficients may be stored in a look-up table ("LUT") in operation 755, as defined in more detail below. Storing these coefficients as entries in a LUT facilitates their later retrieval, and may speed up the process. Generally, a LUT is only employed in embodiments of the present invention using a computing system to spatialize sound. In alternate embodiments, the coefficients may be stored in any other form of database, or may not be stored at all. Each set of FIR coefficients may be stored in a separate LUT, or one LUT may hold multiple set of coefficients. It should be understood the coefficients define the FIR 240.

Once the FIR 240 is constructed from either the HRTF 230 or Bessel function, or both and the coefficients determined, it may be refined to create a more accurate filter. The discrete Fourier transform of the FIR 240 is initially taken. The transform results may be zero-padded by adding zeroes to the end of the transform to reach a desired length. The inverse discrete Fourier transform of the zero-padded result is then taken, resulting in a modified, and more accurate, FIR 240.

The above-described process for creating a FIR 240 is given in more detail below, in the section entitled "Finite Impulse Response Filters."

After the FIR 240 is calculated, audio may be spatialized. Audio spatialization is discussed in more detail below, in the section entitled "Method for Spatializing Sound."

In some embodiments, the spatialized audio waveform 170 may be equalized. This process typically is performed only for audio intended for free-standing speaker 110, 120, 140, 150 playback, rather than playback by headphones. Since headphones are always substantially equidistantly located from a listener's ears, no equalization is necessary. Equalization is typically performed to further spatialize an audio waveform 170 in a "front-to-back" manner. That is, audio equalization may enhance the spatialization of audio with speaker placements in front, to the sides and/or to the rear of the listener. Generally speaking, each waveform or waveform segment played across a discrete speaker set (i.e., each pair of left and right speakers making up the front 110, 120, side, and/or rear 130, 140 sets of speakers) is separately equalized for optimal speaker playback, resulting in each such waveform or segment having a different equalization level. The equalization levels may facilitate or enhance spatialization of the audio waveform. When the audio waveform is played across the speaker sets, the varying equalization levels may create the illusion the waveform transitions between multiple spatial points 150, 150'. This may enhance the illusion of moving sound provided by convolving spatialized waveforms, as discussed below.

Equalization may vary depending on the placement of each speaker pair in a playback space, as well as the projected location of a listener 250. For example, the present embodiment may equalize a waveform differently for differently-configured movie theaters having different speaker setups.

5. Method for Spatializing Sound

Figure 8:
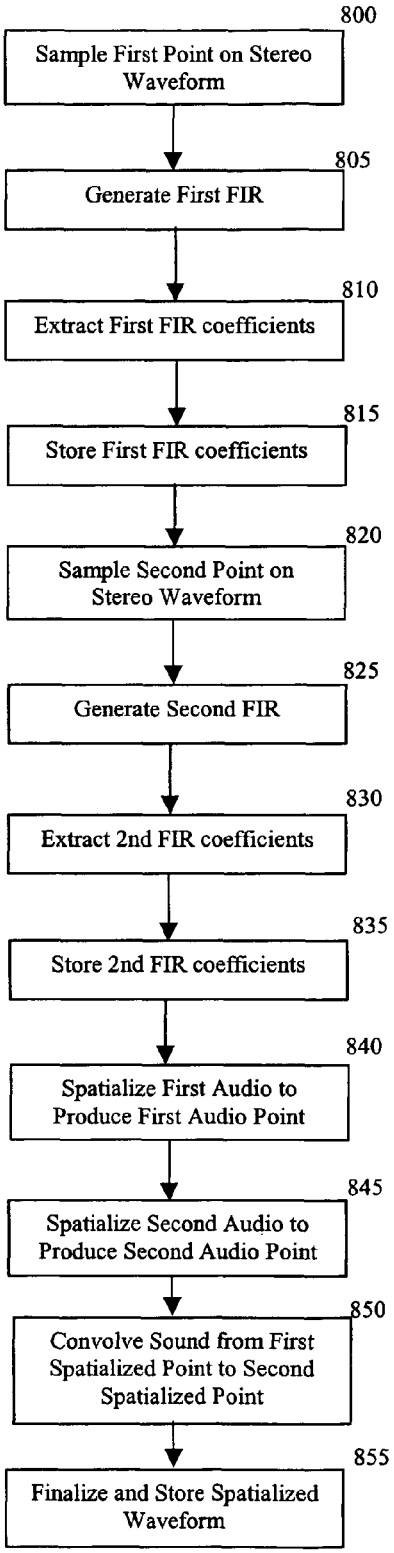
FIG. 8 is a flowchart depicting an exemplary method for spatializing an audio waveform.

FIG. 8 depicts a generalized method for calculating a spatialized sound, as well as producing, from a dichotic waveform 180, a waveform 170 capable of reproducing the spatialized sound.

The process begins in operation 800, where a first portion ("segment") of the stereo waveform 180, or input, is sampled. One exemplary apparatus for sampling the audio waveform is discussed in the section entitled "Audio Sampling Hardware," below. Generally, the sampling procedure digitizes at least a segment of the waveform 180.

Once digitized, the segment may be subjected to a finite impulse response filter 240 in operation 805. The FIR 240 is generally created by subjecting the sampled segment to a variety of spectral analysis techniques, mentioned in passing above and discussed in more detail below. The FIR may be optimized by analyzing and tuning the frequency response generated when the FIR is applied. One exemplary method for such optimization is to first take the discrete Fourier transform of the FIR's frequency response, "zero pad" the response to a desired filter length by adding sufficient zeros to the result of the transform to reach a desired number of significant digits, and calculate the inverse discrete Fourier transformation of the zero padded response to generate a new FIR yielding more precise spatial resolution. Generally, this results in a second frequency impulse response, different from the initially-generated FIR 240.

It should be noted that any number of zeros may be added during the zero padding step. Further, it should be noted that the zeros may be added to any portion of the transform result, as necessary.

Generally, each FIR 240 represents or corresponds to a given HRTF 230. Thus, in order to create the effect that the spatialized audio waveform 170 emanates from a spatial point 150 instead of a pair of speakers 110, 120, the FIR 240 must modify the input waveform 180 in such a manner that the playback sound emulates the HRTF 230 without distorting the acoustic properties of the sound. As used herein, "acoustic properties" refers to the timbre, pitch, color, and so forth perceived by a listener. Thus, the general nature of the sound may remain intact, but the FIR 240 modifies the waveform to simulate the effect of the sound emanating from the desired spatial point.

In order to attain maximally accurate spatialization, it is desirable to use at least two speakers 110, 120. With two speakers, spatialization may be achieved in a plane slightly greater than a hemisphere defined by an arc touching both speakers, with the listener at the approximate center of the hemisphere base. In actuality, sound may be spatialized to apparently emanate from points slightly behind each speaker 110, 120 with reference to the speaker front, as well as slightly behind a listener. In a system employing four or more speakers 110, 120, 140, 150 (typically, although not necessarily, with two speakers in front and two behind a listener), sounds may be spatialized to apparently emanate from any planar point within 360 degrees of a listener. It should be noted that spatialized sounds may appear to emanate from spatial points outside the plane of the listener's ears. In other words, although two speakers 110, 120 may achieve spatialization within 180 degrees, or even more, in front of the listener, the emulated spatial point 150 may be located above or below the speakers and/or listener. Thus, the height of the spatial point 150 is not necessarily limited by number of speakers 110 or speaker placement. It should be further noted the present embodiment may spatialize audio for any number of speaker setups, such as 5.1, 6.1, and 7.1 surround sound speaker setups. Regardless of the number of speakers 110, the spatialization process remains the same. Although compatible with multiple surround sound speaker setups, only two speakers 110, 120 are required.

It should also be noted that spatialization of an audio waveform 170 within a sphere may be achieved where a listener wears headphones, insofar as the headphones are placed directly over the listener's ears. The radius of the spatialization sphere is effectively infinite, bounded only by the listener's aural acuity and ability to distinguish sound.

Once the first FIR 240 is generated, the FIR coefficients are extracted in operation 810. The coefficients may be extracted, for example, by a variety of commercial software packages.

In operation 815, the FIR 240 coefficients may be stored in any manner known to those skilled in the art, such as entries in a look-up table ("LUT") or other database. Typically, the coefficients are electronically stored on a computer-readable medium such as a CD, CD-ROM, Bernoulli drive, hard disk, removable disk, floppy disk, volatile or non-volatile memory, or any other form of optical, magnetic, or magneto-optical media, as well as any computer memory. Alternately, the coefficients may be simply written on paper or another medium instead of stored in a computer-readable memory. Accordingly, as used herein, "stored" or "storing" is intended to embrace any form of recording or duplication, while "storage" refers to the medium upon which such data is stored.

In operation 820, a second segment of the stereo waveform 180' is sampled. This sampling is performed in a manner substantially similar to the sampling in operation 800. Similarly, a second FIR 240' corresponding to a second spatial point 150' is generated in operation 825 in a manner similar to that described with respect to operation 805. The second FIR coefficients are extracted in operation 830 in a manner similar to that described with respect to operation 810, and the extracted second set of coefficients (for the second FIR) are stored in a LUT or other storage in operation 835.

Once the embodiment generates the two FIRs 240, it may spatialize the first and second audio segments. The first FIR coefficients are applied to the first audio segment in operation 840. This application modifies the appropriate segment of the waveform to mimic the HRTF 230 generated by the same audio segment emanating from the spatial point 150. Similarly, the embodiment modifies the waveform to mimic the HRTF of the second spatial point by applying the second FIR coefficients to the second audio segment in operation 845.

Once both spatialization routines are performed, the present embodiment may transition audio spatialization from the first spatial point 150 to the second spatial point. Generally, this is performed in operation 850. Convolution theory may be used to smooth audio transitions between the first and second spatial points 150, 150'. This creates the illusion of a sound moving through space between the points 150, 150', instead of abruptly skipping the sound from the first spatial point to the second spatial point. Convolution of the first and second audio segments to produce this "smoothed" waveform (i.e., "transition audio segment") is discussed in more detail in the section entitled "Audio Convolution," below. Once the first and second audio segments have been spatialized and the convolution procedure carried out, the portion of the waveform 180 corresponding to the first and second audio segments is completely spatialized. This results in a "spatialized waveform" 170.

Finally, in operation 855, the spatialized waveform 170 is stored for later playback.

It should be noted that operations 825-850 may be skipped, if desired. The present embodiment may spatialize an audio waveform 170 for a single point 150 or audio segment, or may spatialize a waveform with a single FIR 240. In such cases, the embodiment may proceed directly from operation 815 to operation 855.

Further, alternate embodiments may vary the order of operations without departing from the spirit or scope of the present invention. For example, both the first and second waveform 180 segments may be sampled before any filters 240 are generated. Similarly, storage of first and second FIR coefficients may be performed simultaneously or immediately sequentially, after both a first and second FIR 240 are created. Accordingly, the afore-described method is but one of several possible methods that may be employed by an embodiment of the present invention, and the listed operations may be performed in a variety of orders, may be omitted, or both.

Finally, although reference has been made to first and second spatial points 150, 150', and convolution therebetween, it should be understood audio segments may be convolved between three, four, or more spatial points. Effectively, convolution between multiple spatial points is handled substantially as above. Each convolution step (first to second point, second to third point, third to fourth point, and so on) is handled separately in the manner previously generally described.

6. Finite Impulse Response Filters

As mentioned above, a stereo waveform 180 may be digitized and sampled. The left and right dichotic channels 190, 200 of an exemplary stereo waveform are shown in FIG. 5. The sampled data may be used to create specific output waveforms 210, 220, such as those shown in FIG. 6, by applying a FIR 240 to the data. The output waveform 170 generally mimics the spatial properties (i.e., inter-aural time delay, altitude, azimuth, and optionally radius) of the input waveform 180 emanating from a specific spatial point corresponding to the FIR.

In order to create the aforementioned FIR 240 or other impulse response filter, an exemplary waveform 180 is played back, emanating from the chosen spatial point 150. The waveform may be sampled by the aforementioned dummy head and associated microphones. The sampled waveform may be further digitized for processing, and an HRTF 230 constructed from the digitized samples.

Figure 11:
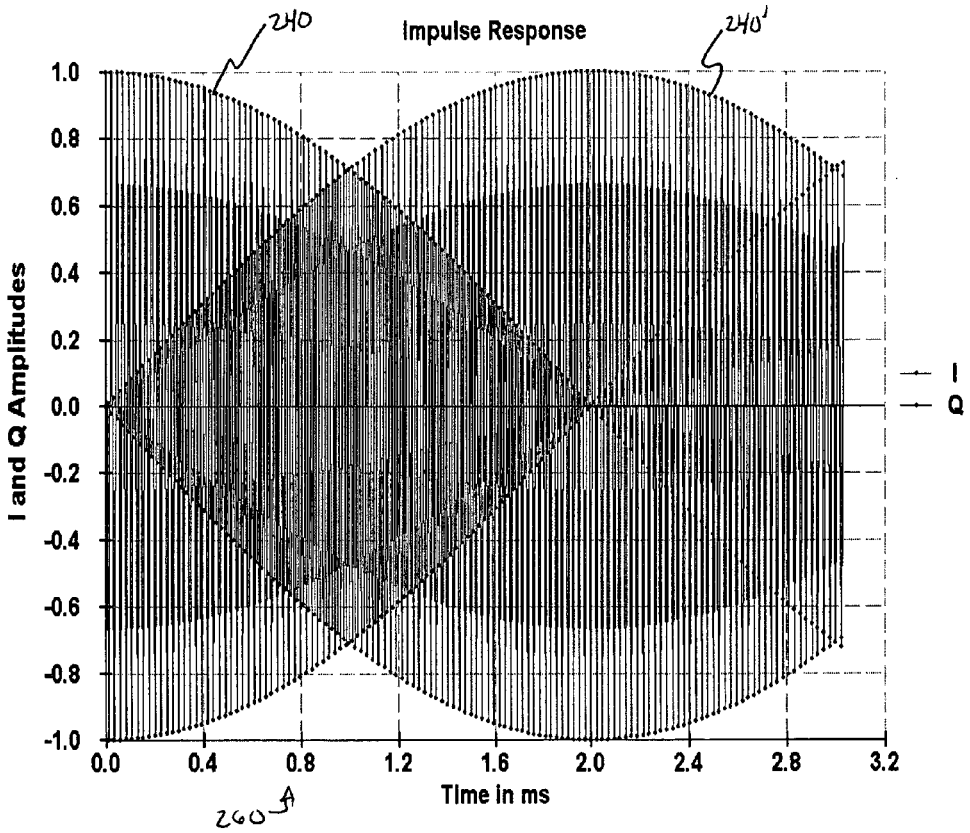
FIG. 11 depicts the interlaced impulse response filters for two spatial points.

Once sampled, the data also may be grouped into various impulse responses and analyzed. For example, graphs showing different plots of the data may be created, including impulse responses and frequency responses. FIG. 11 depicts, for example, one graph 260 of impulse response filters 240, 240' for each of two interlaced spatial points 150, 150'.

Another response amenable to graphing and analysis is magnitude versus frequency, which is a frequency response. Such an exemplary graph 270 is shown in FIGS. 9A and 10A. Generally, any form of impulse or frequency response may be graphed. The graphical representation of an impulse response and/or frequency response may assist in analyzing the associated HRTF 230, and thus better defining the FIR 240. This, in turn, yields more accurate spatialized sound.

Various parametrically defined variables may be modeled to modify or adjust a FIR 240. For example, the number of taps in the filter 240, passband ripple, stopband attenuation, transition region, filter cutoff, waveform rolloff, and so on may all be specified and modeled to vary the resulting FIR 240 and, accordingly, the spatialization of the audio segment. As each variable is adjusted or set, the FIR changes, resulting in different audio spatialization and the generation of different graphs.

Further, the FIR 240 coefficients may be extracted and used either to optimize the filter, or alternately spatialize a waveform without optimization. In the present embodiment, the FIR 240 coefficients may be extracted by a software application. Such an application may be written in any computer-readable code. This application is but one example of a method and program for extracting coefficients from the impulse response filter 240, and accordingly is provided by way of example and not limitation. Those of ordinary skill in the art may extract the desired coefficients in a variety of ways, including using a variety of software applications programmed in a variety of languages.

Because each FIR 240 is a specific implementation of a general case (i.e., a HRTF 230), the coefficients of a given FIR are all that is necessary to define the impulse response. Accordingly, any FIR 240 may be accurately reproduced from its coefficient set. Thus, only the FIR coefficients are extracted and stored (as discussed below), rather than retaining the entire FIR itself. The coefficients may, in short, be used to reconstruct the FIR 240.

The coefficients may be adjusted to further optimize the FIR 240 to provide a closer approximation of the HRTF 230 corresponding to a sound 180 emanating from the spatial point 150 in question. For example, the coefficients may be subjected to frequency response analysis and further modified by zero-padding the FIR 240, as described in more detail below. One exemplary application that may manipulate the FIR coefficients to modify the filter is MATLAB, produced by The MathWorks, Inc. of Natick, Mass. MATLAB permits FIR 240 optimization through use of signal processing functions, filter design functions, and, in some embodiments, digital signal processing ("DSP") functions. Alternate software may be used instead of MATLAB for FIR optimization, or a FIR 240 may be optimized without software (for example, by empirically and/or manually adjusting the FIR coefficients to generate a modified FIR, and analyzing the effect of the modified FIR on an audio waveform). Accordingly, MATLAB is a single example of compatible optimization software, and is given by way of illustration and not limitation.

The FIR 240 coefficients may be converted to a digital format in a variety of ways, one of which is hereby described.

Figure 12:
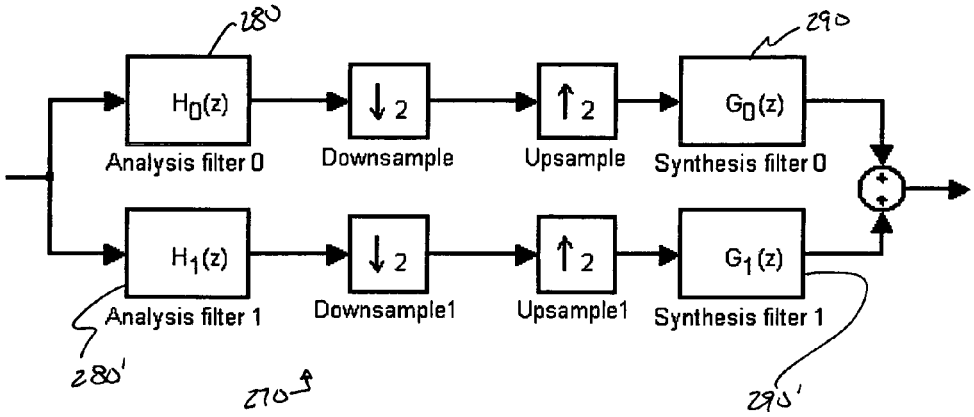
FIG. 12 depicts a two-channel filter bank.

FIG. 12 depicts a two-channel filter bank 270. The filters may be broken into two types, namely analysis filters 280, 280' ($H_0(z)$ and $H_1(z)$) and synthesis filters 290, 290' ($G_0(z)$ and $G_1(z)$). Generally, the filter bank 270 will perfectly reconstruct an input signal 180 if either branch acts solely as a delay, i.e., if the output signal is simply a delayed (and optionally scaled) version of the input signal. Non-optimized FIRs 240 used by the present embodiment (that is, FIRs not yet subjected to zero-padding) would result in perfect reconstruction.

Perfect reconstruction of an input signal 180 may generally be achieved if $$\tfrac{1}{2}G_0(z)H_0(-z)+\tfrac{1}{2}G_1(z)H_1(-z)=0 \text{ and}$$

$$\tfrac{1}{2}G_0(z)H_0(z)+\tfrac{1}{2}G_1(z)H_1(z)=z^{-k}.$$

Given a generic lowpass filter H(z) of odd order N, the following selection for the filters results in perfect reconstruction using solely FIR 240 filters:

$$H_0(z)=H(z)\ H_1(z)=z^{-N}H_0(-z^{-1})$$

$$G_0(z)=2z^{-N}H_0(z^{-1})\ G_1(z)=2z^{-N}H1(z^{-1})$$

This is an orthogonal, or "power-symmetric," filter bank 270. Such filter banks may be designed, for example, in many software applications. In one such application, namely MATLAB, an orthogonal filter bank 270 may be designed by specifying the filter order N and a passband-edge frequency $\omega_p$. Alternately, the power-symmetric filter bank may be constructed by specifying a peak stopband ripple, instead of a filter order and passband-edge frequency. Either set of parameters may be used, solely or in conjunction, to design the appropriate filter bank 270.

It should be understood that MATLAB is given as one example of software capable of constructing an orthogonal filter bank 270, and should not be viewed as the sole or necessary application for such filter construction. Indeed, in some embodiments, the filters 280, 280', 290, 290' may be calculated by hand or otherwise without reference to any software application whatsoever. Software applications may simplify this process, but are not necessary. Accordingly, the present embodiment embraces any software application, or other apparatus or method, capable of creating an appropriate orthogonal filter bank 270.

Returning to the discussion, minimum-order FIR 240 designs may typically be achieved by specifying a passband-edge frequency and peak stopband ripple, either in MATLAB or any other appropriate software application. In a power-symmetric filter bank, $|H_0(e^{jw})|^2+|H_1(e^{jw})|^2=1$, for any passband frequency $\omega_p$.

Figure 13:
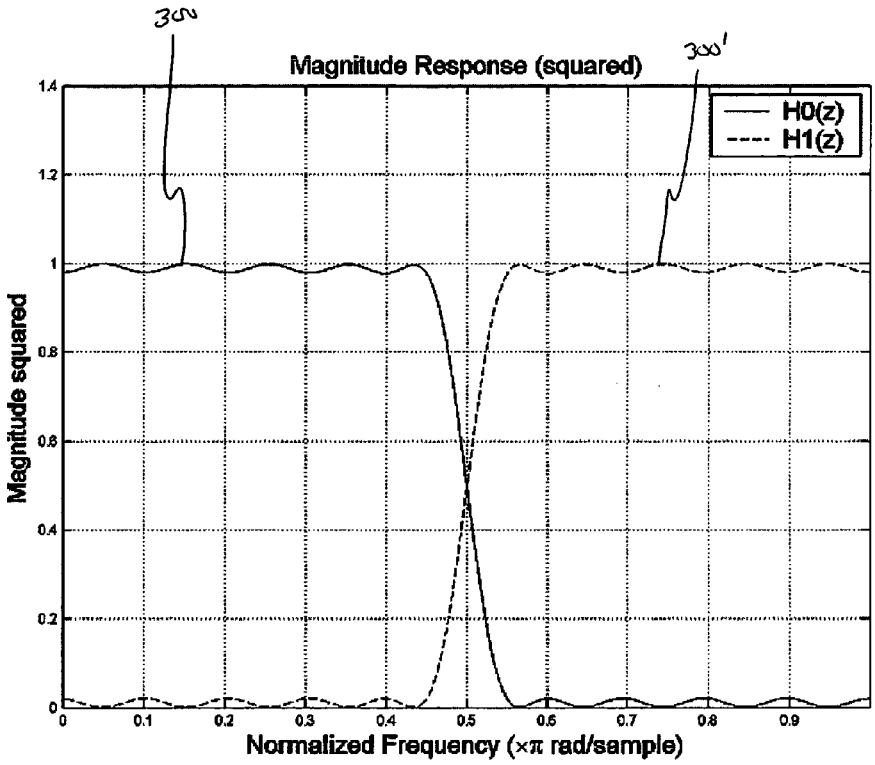
FIG. 13 depicts a graphical plot of magnitude-squared response for exemplary analysis filters $H_0$ and $H_1$, each having a filter order of 19 and passband frequency of $0.45\pi$.

Once the filters 280, 280', 290, 290' are computed, the magnitude-squared responses of the analysis filters 280, 280' may be graphed. FIG. 13 depicts a graphical plot of magnitude-squared response 300, 300' for exemplary analysis filters $H_0$ and $H_1$, each having a filter order of 19 and passband frequency of 0.45π. These values are exemplary, rather than limiting, and are chosen simply to illustrate the magnitude-squared response for corresponding analysis filters 280, 280'.

As shown in FIG. 13, the two filters 280, 280' are power-complementary. That is, as one filter's ripple 300, 300' rises or falls, the second filter's ripple moves in the opposite direction. The sum of the ripples 300, 300' of filters $H_0$ 280 and $H_1$ 280' is always unity. Increasing the filter order and/or passband frequency improves the lowpass and/or highpass separation of the analysis filters 280, 280'. However, such increases generally have no effect on the perfect reconstruction characteristic of the orthogonal filter bank 270, insofar as the sum of the two analysis filters' outputs is always one.

Such filters 280, 280', 290, 290' may be digitally implemented as a series of bits. However, bit implementation (which is generally necessary to spatialize audio waveforms 180 via a digital system such as a computer) may inject error into the filter 240, insofar as the filter must be quantized. Quantization inherently creates certain error, because the analog input (i.e., the analysis filters 280, 280') are separated into discrete packets which at best approximate the input. Thus, minimizing quantization error yields a more accurate digital FIR 240 representation, and thus more accurate audio spatialization.

Generally, quantization of the FIR 240 may be achieved in a variety of ways known to those skilled in the art. In order to accurately quantize the FIR 240 and its corresponding coefficients, and thus achieve an accurate digital model of the FIR, sufficient bits are necessary to both represent the coefficients and achieve the related dynamic filter range. In the present embodiment, each five decibels (dB) of the filter's dynamic range requires a single bit. In some embodiments having less quantization error or less extreme impulse responses, each bit may represent six dB.

In some cases, however, the bit length of the filter 240 may be optimized. For example, the exemplary filter 310 shown in FIG. 14 has an 80 dB attenuation and a largest coefficient of 0.1206. (This filter is unrelated to the impulse response filter 240 depicted in FIGS. 10B and 11A, and is shown for illustrative purposes only).

Figure 15:
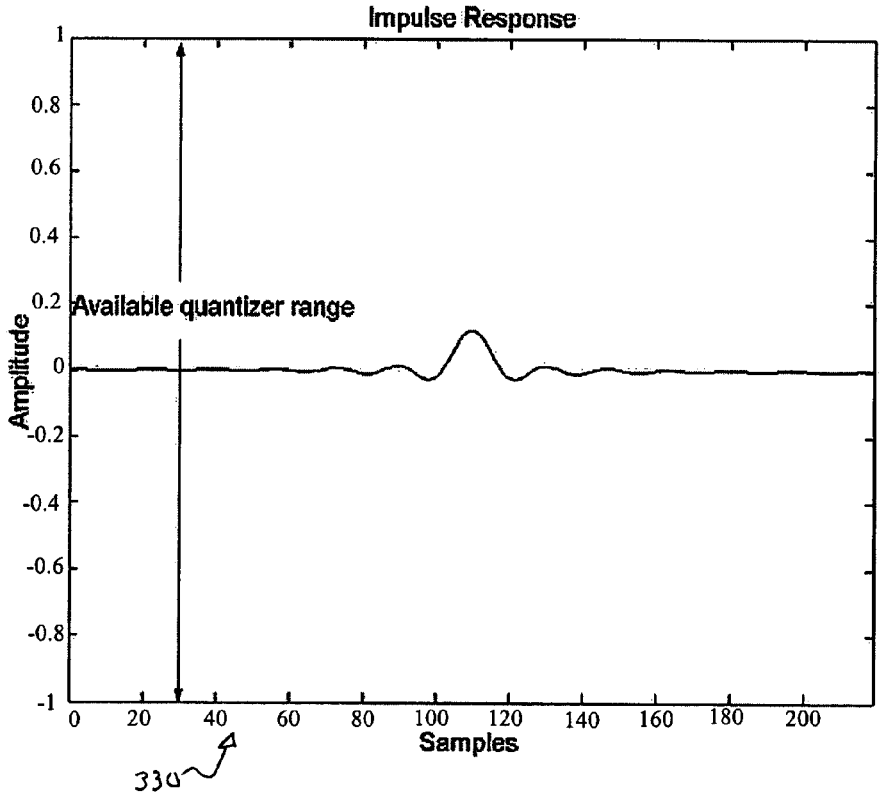
FIG. 15 depicts an impulse response of the filter quantized in FIG. 14, shown relative to an available range for the coefficient format selected.

As shown in FIG. 15, the stopband attenuation 330 for the quantized filter response 310 may be significantly less than the desired 80 dB at various frequency bands.

Figure 16:
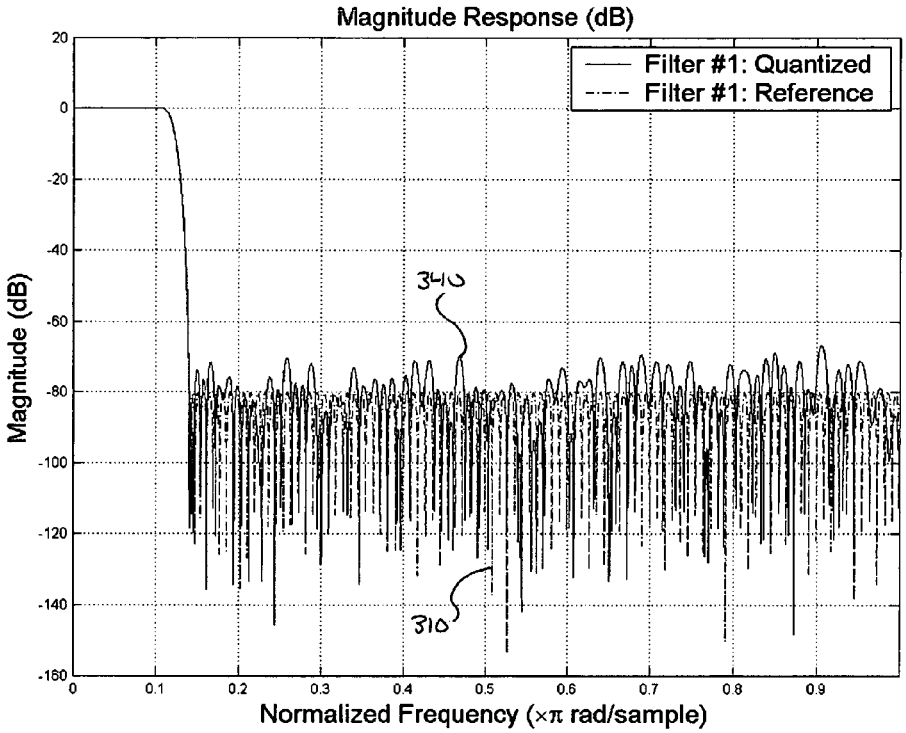
FIG. 16 depicts a magnitude response for the filter of claim 14 after quantization.

FIG. 16 depicts both the reference filter response 310 (in dashed line) and the filter response 340 after quantization (in solid line). It should be noted that different software applications may provide slightly different quantization results. Accordingly, the following discussion is by way of example and not limitation. Certain software applications may accurately quantize a filter 240, 310 to such a degree that optimization of the filter's bit length is unnecessary.

Figure 14:
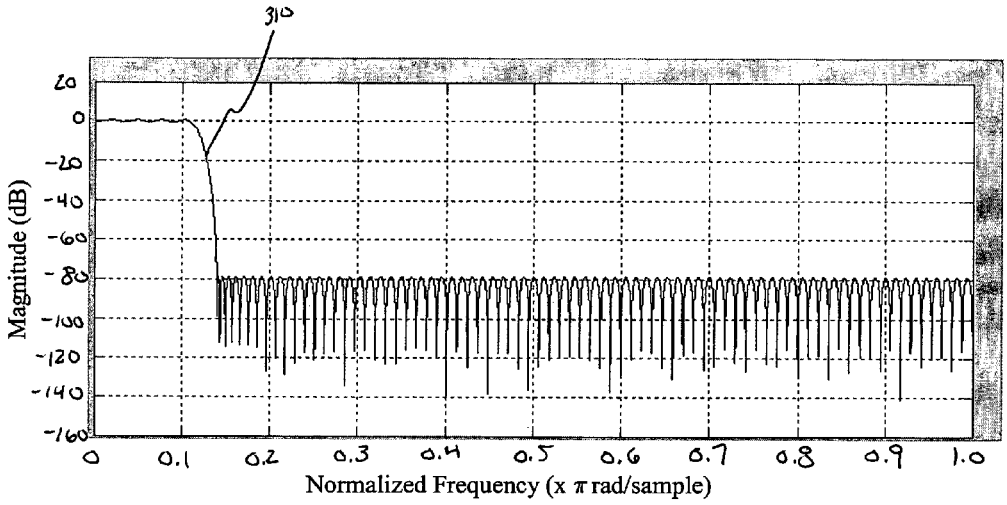
FIG. 14 depicts a graphical representation of a magnitude response of a filter having an 80 dB attenuation and a largest coefficient of 0.1206.

The filter response 310 shown in FIGS. 14 and 16 may vary from the response 340 shown in FIG. 16 due to error resulting from the chosen quantization bitlength. FIG. 16 depicts the variance between quantized and reference filters. Generally, a tradeoff exists between increased filter accuracy and increased computing power required to process the filter, along with increased storage requirements, all of which increase as quantization bitlength increases.

Figure 17:
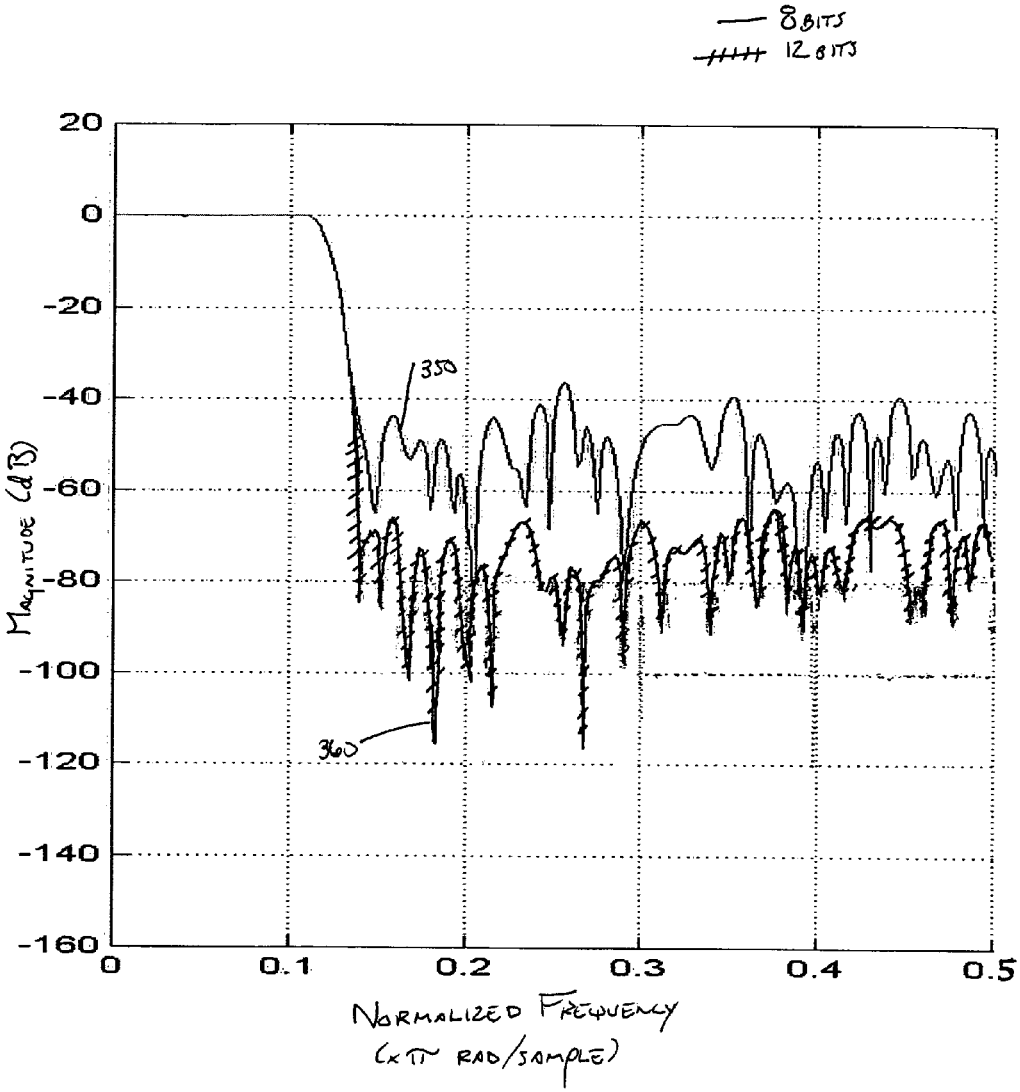
FIG. 17 depicts magnitude responses for various quantizations of the filter of FIG. 14, with 80 dB stopband attenuation.

The magnitude response of multiple quantizations 350, 360 of the FIR may be simultaneously plotted to provide frequency analysis data. FIG. 17, for example, depicts a portion of a magnitude vs. frequency graph for two digitized implementations of the filter. This may, for example, facilitate choosing the proper bitlength for quantizing the FIR 240, and thus creating a digitized representation more closely modeling the HRTF 230 while minimizing computing resources. As shown in FIG. 17, as bitlength increases, the magnitude response of the digitized FIR 240 representation generally approaches the actual filter response.

As previously mentioned, these graphs may be reviewed to determine how accurately the FIR 240 emulates the HRTF 230. Thus, this information assists in fine-tuning the FIR. Further, the FIR's 240 spatial resolution may be increased beyond that provided by the initially generated FIR. Increases in the spatial resolution of the FIR 240 yield increases in the accuracy of sound spatialization by more precisely emulating the spatial point from which a sound appears to emanate.

The first step in increasing FIR 240 resolution is to take the discrete Fourier transform ("DFT") of the FIR. Next, the result of the DFT is zero-padded to a desired filter length by adding zeros to the end of the DFT. Any number of zeros may be added. Generally, zero-padding adds resolution by increasing the length of the filter.

After zero-padding, the inverse DFT of the zero-padded DFT result is taken. Skipping the zero-padding step would result in simply reconstructing the original FIR 240 by subjecting the FIR to a DFT and inverse DFT. However, because the results of the DFT are zero-padded, the inverse DFT of the zero-padded results creates a new FIR 240, slightly different from the original FIR. This "padded FIR" encompasses a greater number of significant digits, and thus generally provides a greater resolution when applied to an audio waveform to simulate a HRTF 230.

The above process may be iterative, subjecting the FIR 240 to multiple DFTs, zero-padding steps, and inverse DFTs. Additionally, the padded FIR may be further graphed and analyzed to simulate the effects of applying the FIR 240 to an audio waveform. Accordingly, the aforementioned graphing and frequency analysis may also be repeated to create a more accurate FIR.

Once the FIR 240 is finally modified, the FIR coefficients may be stored. In the present embodiment, these coefficients are stored in a look-up table (LUT). Alternate embodiments may store the coefficients in a different manner.

It should be noted that each FIR 240 spatializes audio for a single spatial coordinate 150. Accordingly, multiple FIRs 240 are developed to provide spatialization for multiple spatial points 150. In the present embodiment, at least 20,000 unique FIRs are calculated and tuned or modified as necessary, providing spatialization for 20,000 or more spatial points. Alternate embodiments may employ more or fewer FIRs 240. This plurality of FIRs generally permits spatialization of an audio waveform 180 to the aforementioned accuracy and within the aforementioned error values. Generally, this error is smaller than the unaided human ear can detect.

Since the error is below the average listener's 250 detection threshold, speaker 110, 120, 140, 150 cross-talk characteristics become negligible and yield little or no impact on audio spatialization achieved through the present invention. Thus, the present embodiment does not adjust FIRs 240 to account for or attempt to cancel cross-talk between speakers 110, 120, 140, 150. Rather, each FIR 240 emulates the HRTF 230 of a given spatial point 150 with sufficient accuracy that adjustments for cross-talk are rendered unnecessary.

7. Filter Application

Once the FIR 240 coefficients are stored in the LUT (or other storage scheme), they may be applied to either the waveform used to generate the FIR or another waveform 180. It should be understood that the FIRs 240 are not waveform-specific. That is, each FIR 240 may spatialize audio for any portion of any input waveform 180, causing it to apparently emanate from the corresponding spatial point 150 when played back across speakers 110, 120 or headphones. Typically, each FIR operates on signals in the audible frequency range, namely 20-20,000 Hz. In some embodiments, extremely low frequencies (for example, 20-1,000 Hz) may not be spatialized, insofar as most listeners typically have difficulty pinpointing the origin of low frequencies. Although waveforms 180 having such frequencies may be spatialized by use of a FIR 240, the difficulty most listeners would experience in detecting the associated sound localization cues minimizes the usefulness of such spatialization. Accordingly, by not spatializing the lower frequencies of a waveform 180 (or not spatializing completely low frequency waveforms), the computing time and processing power required in computer-implemented embodiments of the present invention may be reduced. Accordingly, some embodiments may modify the FIR 240 to not operate on the aforementioned low frequencies of a waveform, while others may permit such operation.

The FIR coefficients (and thus, the FIR 240 itself) may be applied to a waveform 180 segment-by-segment, and point-by-point. This process is relatively time-intensive, as the filter must be mapped onto each audio segment of the waveform. In some embodiments, the FIR 240 may be applied to the entirety of a waveform 180 simultaneously, rather than in a segment-by-segment or point-by-point fashion.

Alternately, the present embodiment may employ a graphic user interface ("GUI"), which takes the form of a software plug-in designed to spatialize audio 180. This GUI may be used with a variety of known audio editing software applications, including PROTOOLS, manufactured by Digidesign, Inc. of Daly City, Calif., DIGITAL PERFORMER, manufactured by Mark of the Unicorn, Inc. of Cambridge, Mass., CUBASE, manufactured by Pinnacle Systems, Inc. of Mountain View, Calif., and so forth.

In the present embodiment, the GUI is implemented to operate on a particular computer system. The exemplary computer system takes the form of an APPLE MACINTOSH personal computer having dual G4 or G5 central processing units, as well as one or more of a 96 kHz/32-bit, 96 kHz/16-bit, 96 kHz/24-bit, 48 kHz/32-bit, 48 kHz/16-bit, 48 kHz/24-bit, 44.1 kHz/32-bit, 44.1 kHz/16-bit, and 44.1 kHz/24-bit digital audio interfaces. Effectively, any combination of frequency and bitrate digital audio interface may be used, although the ones listed are most common. The set of digital audio interfaces is employed varies with the sample frequency of the input waveform 180, with lower sampling frequencies typically employing the 48 Khz interface. It should be noted that alternate embodiments of the present invention may employ a GUI optimized or configured to operate on a different computer system. For example, an alternate embodiment may employ a GUI configured to operate on a MACINTOSH computer having different central processing units, an IBM-compatible personal computer, a personal computer running operating systems such as WINDOWS, UNIX, LINUX, and so forth.

When the GUI is activated, it presents a specialized interface for spatializing audio waveforms 180, including left 190 and right 200 dichotic channels. The GUI may permit access to a variety of signal analysis functions, which in turn permits a user of the GUI to select a spatial point for spatialization of the waveform. Further, the GUI typically, although not necessarily, displays the spherical coordinates ($r_n$, $\theta_n$, $\phi_n$) for the selected spatial point 150. The user may change the selected spatial point by clicking or otherwise selecting a different point.

Once a spatial point 150 is selected for spatialization, either through the GUI or another application, the user may instruct the computer system to retrieve the FIR 240 coefficients for the selected point from the look-up table, which may be stored in random access memory (RAM), read-only memory (ROM), on magnetic or optical media, and so forth. The coefficients are retrieved from the LUT (or other storage), entered into the random-access memory of the computer system, and used by the embodiment to apply the corresponding FIR 240 to the segment of the audio waveform 180. Effectively, the GUI simplifies the process of applying the FIR to the audio waveform segment to spatialize the segment.

It should be noted the exemplary computing system may process (i.e., spatialize) up to twenty-four (24) audio channels simultaneously. Some embodiments may process up to forty-eight (48) channels, and other even more. It should further be noted the spatialized waveform 170 resulting from application of the FIR 240 (through the operation of the GUI or another method) is typically stored in some form of magentic, optical, or magneto-optical storage, or in volatile or non-volatile memory. For example, the spatialized waveform may be stored on a CD for later playback.

In non-computer implemented embodiments, the aforementioned processes may be executed by hand. For example, the waveform 180 may be graphed, the FIR 240 calculated, and FIR applied to the waveform with all calculations being done without computer aid. The resulting spatialized waveform 170 may then be reconstructed as necessary. Accordingly, it should be understood the present invention embraces not only digital methods and apparatuses for spatializing audio, but non-digital ones as well.

When the spatialized waveform 170 is played in a standard CD or tape player, and/or compressed audio/video format such as DVD-audio or MP3 format, and projected from one or more speakers 110, 120, 140, 150, the spatialization process is such that no special decoding equipment is required to create the spatial illusion of the spatialized audio 170 emanating from the spatial point 150 during playback. In other words, unlike current audio spatialization techniques such as DOLBY, LOGIC7, DTS, and so forth, the playback apparatus need not include any particular programming or hardware to accurately reproduce the spatialization of the waveform 180. Similarly, spatialization may be accurately experienced from any speaker 110, 120, 140, 150 configuration, including headphones, two-channel audio, three- or four-channel audio, five-channel audio or more, and so forth, either with or without a subwoofer.

8. Audio Convolution

As mentioned above, the GUI, or other method or apparatus of the present embodiment, generally applies a FIR 240 to spatialize a segment of an audio waveform 180. The embodiment spatialize multiple audio segments, with the result that the various segments of the waveform 170 may appear to emanate from different spatial points 150, 150'.

In order to prevent spatialized audio 180 from abruptly and discontinuously moving between spatial points 150, 150', the embodiment may also transition the spatialized sound waveform 180 from a first to a second spatial point. This may be accomplished by selecting a plurality of spatial points between the first 150 and second 150' spatial points, and applying the corresponding FIRs 240, 240' for each such point to a different audio segment. Alternately, and as performed by the present embodiment, convolution theory may be employed to transition the first spatialized audio segment to the second spatialized audio segment. By convolving the endpoint of the first spatialized audio segment into the beginning point of the second spatialized audio segment, the associated sound will appear to travel smoothly between the first 150 and second 150' spatial points. This presumes an intermediate transition waveform segment exists between the first spatialized waveform segment and second spatialized waveform segment. Should the first and second spatialized segments occur immediately adjacent one another on the waveform, the sound will "jump" between the first 150 and second 150' spatial points.

It should be noted, as mentioned above, that the present embodiment employs spherical coordinates for convolution. This generally results in quicker convolutions (and overall spatialization) requiring less processing time and/or computing power. Alternate embodiments may employ different coordinate systems, such as Cartesian or cylindrical coordinates.

Generally, the convolution process extrapolates data both forward from the endpoint of the first spatialized audio waveform 170 and backward from the beginning point of the second spatialized waveform 170' to result in an accurate extrapolation of the transition, and thus spatialization of the intermediate waveform segment. It should be noted the present embodiment may employ either a finite impulse response 240 or an infinite impulse response when convolving an audio waveform 180 between two spatial points 150, 150'. This section generally presumes a finite impulse response is used for purposes of convolution, although the same principles apply equally to use of an infinite impulse response filter.

A short discussion of the mathematics of convolution may prove useful. It should be understood that all mathematical processes are generally carried out by a computing system in the present embodiment, along with software configured to perform such tasks. Generally, the aforementioned GUI may perform these tasks, as may the MATLAB application also previously mentioned. Additional software packages or programs may also convolve a spatialized waveform 170 between first 150 and second 150' spatial points when properly configured. Accordingly, the following discussion is intended by way of representation of the mathematics involved in the convolution process, rather than by way of limitation or mere recitation of algorithms.

A short, stationary audio signal segment can be mathematically approximated by a sum of cosine waves with the frequencies $f_i$ and phases $\phi_i$ multiplied by an amplitude envelope function $A_i(t)$, such that:

$$x(t) = \sum_i A_i(t)\cos(2\pi f_i t + \varphi_i),\ f_i \geq 0.$$

Generally, an amplitude envelope function slowly varies for a relatively stationary spatialized audio segment (i.e., a waveform 180 appearing to emanate at or near a single spatial point 150). However, for the intermediate waveform segments (i.e., the portion of a spatialized waveform 170 or waveform segments transitioning between two or more spatial points 150, 150'), the amplitude envelope function experiences relatively short rise and decay times, which in turn may strongly affect the spatialized waveform's 170 amplitude. The cosine function, by which the amplitude function is multiplied in the above formula, can be further decomposed into superposition of phasors according to Euler's formula:

$$\cos\omega t = \frac{e^{i\omega t} + e^{-i\omega t}}{2},$$

Here, ω is the angular frequency. The spectrum of a single phasor may be mathematically expressed as Dirac's delta function. A single impulse response coefficient is required to extrapolate a phasor, as follows:

$$e^{i\omega n\Delta t} = h_1 e^{i\omega(n-1)\Delta t},\ \text{where } h_1 = e^{i\omega\Delta t}.$$

Where a FIR 240 is used for convolution the impulse response coefficient(s) may be obtained from the LUT, if desired.

Two real valued coefficients are required to extrapolate a cosine wave, which is a sum of two phasors:

$$\cos(\omega n\Delta t) = h_1 \frac{e^{i\omega(n-1)\Delta t} + e^{-i\omega(n-1)\Delta t}}{2} + h_2 \frac{e^{i\omega(n-2)\Delta t} + e^{-i\omega(n-2)\Delta t}}{2},$$

where the impulse response coefficients are $h_1 = 2\cos(\omega\Delta t)$ and $h_2 = -1$. Again, if a FIR 240 is used, the coefficients may be retrieved from the aforementioned LUT.

The transfer function consists of both real and imaginary parts, both of which are used for extrapolation of a single cosine wave. The sum of two cosine waves with different frequencies (and constant amplitude envelopes) requires four impulse response coefficients for perfect extrapolation.

The present embodiment spatializes audio waveforms 180, which may be generally thought of as a series of time-varying cosine waves. Perfect extrapolation of a time-varying cosine wave (i.e., of a spatialized audio waveform 170 segment) is possible only where the amplitude envelope of the segment is either an exponential or polynomial function. For perfect extrapolation of a cosine wave with a non-constant amplitude envelope, a longer impulse response is typically required.

The number of impulse response coefficients required to perfectly extrapolate each time varying cosine wave (i.e., spatialized audio segment) making up the spatialized audio waveform 170 can be observed by decomposing the cosine wave in exponential form, as follows:

$$x(t) = A(t)\cos(\omega t) = \frac{A(t)}{2}e^{i\omega t} + \frac{A(t)}{2}e^{-i\omega t}.$$

If m is the number of impulse response coefficients required to perfectly extrapolate the amplitude envelope function A(t), then A(t) multiplied by an exponent function may be perfectly extrapolated with m impulse response coefficients. Each component in the right-hand sum of the equation above requires m coefficients. This, in turn, dictates a cosine wave with a time varying amplitude envelope requiring 2 m coefficients for perfect extrapolation.

Similarly, a polynomial function requires q+1 impulse response coefficients for perfect extrapolation, where q is the order of the polynomial. For example, a cosine wave with a third degree polynomial decay requires eight impulse response coefficients for perfect extrapolation.

Typically, a spatialized audio waveform 180 contains a large number of frequencies. The time varying nature of these frequencies generally require a higher model order than does a constant amplitude envelope, for example. Thus, a very large model order is usually required for good extrapolation results (and thus more accurate spatialization). Approximately two hundred to twelve hundred impulse response coefficients are often required for accurate extrapolation. This number may vary depending on whether specific acoustic properties of a room or presentation area are to be emulated (for example, a concert hall, stadium, or small room), displacement of the spatial point 150 from the listener 250 and/or speaker 110, 120, 140, 150 replicating the audio waveform 170, transition path between first and second spatial points, and so on.

The impulse response coefficients used during the convolution process, to smooth transition of spatialized audio 180 between a first 150 and second 150' spatial point, may be calculated by applying the formula for decomposing a cosine wave (given above) to a known waveform segment. Typically, this formula is applied to a segment having N samples, and generates a group of M equations. This group of equations is given in matrix form as:

$$Xh=x,$$

where $h=[h_1, h_2, \ldots, h_M]^T$, $x=[x_{M+1}, x_{M+2}, \ldots, x_{2M}]^T$, and 2M=N. The matrix X is composed of shifted signal samples:

$$X = \begin{pmatrix} x_M & x_{M-1} & x_{M-2} & \ldots & x_1 \\ x_{M+1} & x_M & x_{M-1} & \ldots & x_2 \\ \vdots & \vdots & \vdots & \ldots & \\ x_{2M-1} & x_{2M-2} & x_{M-3} & \ldots & x_M \end{pmatrix}$$

However, an exact analytical solution for h exists only for noiseless signals, which are theoretical in nature. Practically speaking, all audio waveforms 170, 180 include at least some measure of noise. Accordingly, for audio waveforms, an interactive approach may be used.

Information is drawn from multiple sources to extrapolate the appropriate filter 240. Some information is drawn from the intermediate waveform, while some is drawn from the calculated impulse response coefficients. Typically, convolution is carried out not between the end of one waveform 170 (or segment) and the beginning of another waveform (or segment), but instead takes into account several points before and after the end and beginning of such waveforms. This ensures a smooth transition between convolved spatialized waveforms 170, rather than a linear transition between the first waveform's endpoint and second waveform's start point. By taking into account short segments of both waveforms, the convolution/transition waveform/segment resulting from the convolution operation described herein smoothes the transition between the two audio waveforms/segments.

The impulse response coefficients, previously calculated and discussed above, mainly yield information about the frequencies of the sinusoids and their amplitude envelopes. By contrast, information regarding the amplitude and phase information of the extrapolated sinusoids comes from the spatialized waveform 170.

After the forward (and/or backward) extrapolation process is completed for each spatialized waveform segment, the transition between waveform segments may be convolved. The segments are convolved by applying the formula for two-dimensional convolution, as follows:

$$c(n_1, n_2) = \sum_{k_1=-\infty}^{\infty} \sum_{k_2=-\infty}^{\infty} a(k_1, k_2)b(n_1 - k_1, n_2 - k_2)$$

where a and b are functions of two discrete variables $n_1$ and $n_2$. Here, $n_1$ represents the first spatialized waveform segment, while $n_2$ represents the second spatialized waveform segment. The segments may be portions of a single spatialized waveform 170 and/or its component dichotic channels 210, 220, or two discrete spatialized waveforms. Similarly, a represents the coefficients of the first impulse response filter 240, and b represents the coefficients of the second impulse response filter. This yields a spatialized intermediate or "transition" segment between the first and second spatialized segments having a smooth transition therebetween.

An alternate embodiment may multiply the fast Fourier transforms of the two waveform segments and take the inverse fast Fourier transform of the product, rather than convolving them. However, in order to obtain accurate transition between the first and second spatialized waveform segments, the vectors for each segment must be zero-padded and roundoff error ignored. This yields a spatialized intermediate segment between the first and second spatialized segments.

Once the spatialized intermediate audio segment is calculated, the spatialized waveform 170 is complete. The spatialized waveform 170 now consists of the first spatialized waveform segment, the intermediate spatialized waveform segment, and the second spatialized waveform segment. The spatialized waveform 170 may be imported into an audio editing software application, such as PROTOOLS, Q-BASE, or DIGITAL PERFORMER and stored as a computer-readable file. In alternate embodiments, the GUI may store the spatialized waveform 170 without requiring import into a separate software application. Typically, the spatialized waveform is stored as a digital file, such as a 48 kHz, 24 bit wave (.WAV) or AIFF file. Alternate embodiments may digitize the waveform at varying sample rates (such as 96 kHz, 88.2 kHz, 44.1 kHz, and so on) or varying resolutions (such as 32 bit, 24 bit, 16 bit, and so on). Similarly, alternate embodiments may store the digitized, spatialized waveform 170 in a variety of file formats, including audio interchange format (AIFF), MPEG-3 (MP3) other MPEG-compliant, next audio (AU), Creative Labs music (CMF), digital sound module (DSM), and other file formats known to those skilled in the art, or later-created.

Once stored, the file may be converted to standard CD audio for playback through a CD player. One example of a CD audio file format is the .CDA format. As previously mentioned, the spatialized waveform 170 may accurately reproduce audio and spatialization through standard audio hardware (i.e., speakers 110, 120 and receivers), without requiring specialized reproduction/processing algorithms or hardware.

9. Audio Sampling Hardware

In the present embodiment, an input waveform 180 is sampled and digitized by an exemplary apparatus. This apparatus further may generate the aforementioned finite impulse response filters 240. Typically, the apparatus (also referred to as a "binaural measurement system") includes a DSP dummy head recording device, 24 bit 96 kHz sound card, digital programmable equalizer(s), power amplifier, optional headphones (preferably, but not necessarily electrostatic), and a computer running software for calculating time and/or phase delays to generate various reports and graphs. Sample reports and graphs were discussed above.

The DSP dummy head typically is constructed from plastic, foam, latex, wood, polymer, or any other suitable material, with a first and second microphone placed at locations approximating ears on a human head. The dummy head may contain specialized hardware, such as a DSP processing board and/or an interface permitting the head to be connected to the sound card.

The microphones typically connect to the specialized hardware within the dummy head. The dummy head, in turn, attaches to the sound card via a USB or AES/XLR connection. The sound card may be operably attached to one or both of the equalizer and amplifier. Ultimately, the microphones are operably connected to the computer, typically through the sound card. As a sound wave 180 impacts the microphones in the dummy head, the sound level and impact time are transmitted to the sound card, which digitizes the microphone output. The digital signal may be equalized and/or amplified, as necessary, and transmitted to the computer. The computer stores the data, and may optionally calculate the inter-aural time delay between the sound wave impacting the first and second microphone. This data may be used to construct the HRTF 230 and ultimately spatialize audio 180, as previously discussed. Electrostatic headphones reproduce audio (both spatialized 170 and non-spatialized 180) for the listener 250.

Alternate binaural spatialization and/or digitization systems may be used by alternate embodiments of the present invention. Such alternate systems may include additional hardware, may omit listed hardware, or both. For example, some systems may substitute different speaker configurations for the aforementioned electrostatic headphones. Two speakers 110, 120 may be substituted, as may any surround-sound configuration (i.e., four channel, five channel, six channel, seven channel, and so forth, either with or without a subwoofer(s)). Similarly, an integrated receiver may be used in place of the equalizer and amplifier, if desired.

10. Spatialization of Multiple Sounds

Some embodiments may permit spatialization of multiple waveforms 180, 180'. FIG. 1, for example, depicts a first waveform 180 emanating from a first spatial point 150, and a second waveform 180' emanating from a second spatial point 150'. By "time-slicing," a listener may perceive multiple waveforms 170, 170' emanating from multiple spatial points substantially simultaneously. This is generally graphically shown in FIGS. 11A and 11B. Each spatialized waveform 170, 170' may apparently emanate from a unique spatial point 150, 150', or one or more waveforms may apparently emanate from the same spatial point. The time-slicing process typically occurs after each waveform 180, 180' has been spatialized to produce a corresponding spatialized waveform 170, 170'.

Figure 18:
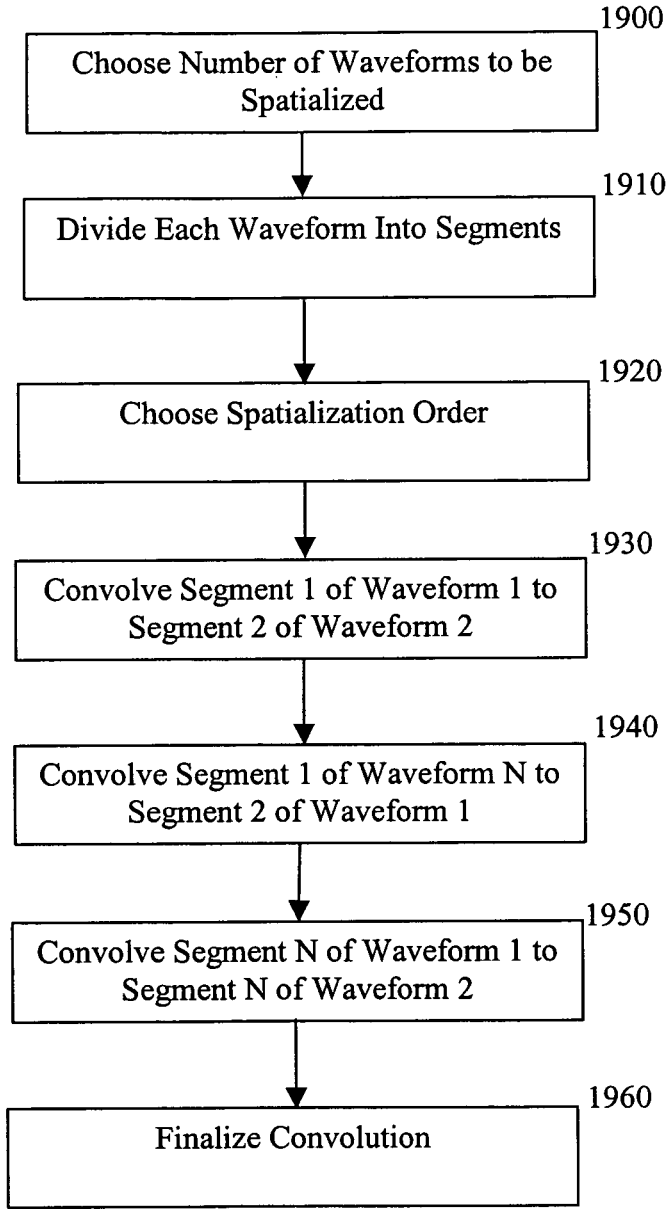
FIG. 18 is a flowchart depicting an exemplary method for spatializing multiple audio waveforms into a single waveform.

A method for time-slicing is generally shown in FIG. 18. First, the number of different waveforms 170 to be spatialized is chosen in operation 1900. Next, in operation 1910, each waveform 170, 170' is divided into discrete time segments, each of the same length. In the present embodiment, each time segment is approximately 10 microseconds long, although alternate embodiments may employ segments of different length. Typically, the maximum time of any time segment is one millisecond. If a time segment exceeds this length of time, the human ear may discern breaks in each audio waveform 170, or pauses between waveforms, and thus perceive degradation in the multiple point spatialization process.

In operation 1920, the order in which the audio waveforms 170, 170' will be spatialized is chosen. It should be noted this order is entirely arbitrary, so long as the order is adhered to throughout the time-slicing process. In some embodiments, the order may be omitted, so long as each audio waveform 170, 070' occupies one of every n time segments, where n is the number of audio waveforms being spatialized.

In operation 1930, a first segment of audio waveform 1 170 is convolved to a first segment of audio waveform 2 170'. This process is performed as discussed above. FIGS. 11A and 11B depict the mix of two different impulse responses. Returning to FIG. 18, operation 1930 is repeated until the first segment of audio waveform n−1 is convolved to the first segment of audio waveform n, thus convolving each waveform to the next. Generally, each segment of each audio waveform 170 is x seconds long, where x equals the time interval chosen in operation 1910.

In operation 1940, the first segment of audio waveform n is convolved to the second segment of audio waveform 1. Thus, each segment of each waveform 170 convolves not to the next segment of the same waveform, but instead to a segment of a different waveform 170'.

In operation 1950, the nth segment of audio waveform 1 170 is convolved to the nth segment of audio waveform 2 170', which is convolved to the nth segment of audio waveform 3, and so on. Operation 1950 is repeated until all segments of all waveforms 170, 170' have been convolved to a corresponding segment of a different waveform, and no audio waveform has any unconvolved time segments. In the event that one audio waveform 170 ends prematurely (i.e., before one or more other audio waveforms terminate), the length of the time segment is adjusted to eliminate the time segment for the ended waveform, with each time segment for each remaining audio waveform 170' increasing by an equal amount.

Thus, the resulting convolved, aggregate waveform is a montage of all initial, input audio waveforms 170, 170'. Rather than convolving a single waveform to create the illusion of a single audio output moving through space, the aggregate waveform essentially duplicates multiple sounds, and jumps from one sound to another, creating the illusion that each moves between spatial points 150, 150' independently. Because the human ear cannot perceive the relatively short lapses in time between segment n and segment n+1 of each spatial waveform 170, 070', the sounds seem continuous to a listener when the aggregate waveform is played. No skipping or pausing is typically noticed. Thus, a single output waveform may be the result of convolving multiple spatialized input waveforms 170, 070', one to the other, and yield the illusion that multiple, independent sounds emanate from multiple, independent spatial points 150, 150' simultaneously.

11. Conclusion

As will be recognized by those skilled in the art from the foregoing description of example embodiments of the invention, numerous variations on the described embodiments may be made without departing from the spirit and scope of the invention. For example, a different filter may be used (such as an infinite impulse response filter), filter coefficients may be stored differently (for example, as entries in a SQL database), or a fast Fourier transform may be used in place of convolution theory to smooth spatialization between two points. Further, while the present invention has been described in the context of specific embodiments and processes, such descriptions are by way of example and not limitation. Accordingly, the proper scope of the present invention is specified by the following claims and not by the preceding examples.

I claim:

1. A method for spatializing an audio waveform, comprising:

determining a first four-dimensional spatial point in a spherical coordinate system;

calculating a first head-related transfer function for the first four-dimensional spatial point;

determining a second four-dimensional spatial point in a spherical coordinate system;

calculating a second head-related transfer function for the second four-dimensional spatial point, wherein a similarity exists between the first and second four-dimensional points;

applying first and second impulse response filters corresponding to the first and second spatial points to first and second segments of the audio waveform to yield first and second spatialized waveforms;

extrapolating data both forward from an end portion of the first spatialized waveform and backward from a beginning portion of the second spatialized waveform to create a fully spatialized waveform for a path between the first and second spatial points, wherein the path varies with at least two dimensions of the first and second spatial points; and storing the fully spatialized waveform on a physical storage as a digital file operable to be played by a computing device.

2. The method of claim 1, wherein each of first and second impulse response filters comprises a finite impulse response filter.

3. The method of claim 1, further comprising creating the first impulse response filter from the first head-related transfer function.

4. The method of claim 3, further comprising storing at least one coefficient for the first head-related transfer function in a look-up table on one of the group comprising a volatile memory, a magnetic storage medium, and an optical storage medium.

5. The method of claim 1, further comprising creating a second impulse response filter from the second head-related transfer function.

6. A non-transitory computer-readable medium containing computer-executable instructions which, when accessed, perform the method of claim 1.

7. A computer configured to execute the method of claim 1.

8. The method of claim 1, whereby the fully spatialized waveform is substantially free of discontinuities resulting from spatializing the audio waveform as it moves between the first and second four-dimensional points.

9. The method of claim 1, wherein the at least two dimensions include the time dimension.

10. The method of claim 1, wherein the second head-related transfer function is calculated based upon the first head-related transfer function wherein the calculation of the second head-related transfer function comprises calculating a second phase response of the second head-related transfer function based upon a first phase response of the first head-related transfer function and the second head-related transfer function comprises at least one coefficient that is different than a coefficient of the first head-related transfer function.

11. An apparatus for spatializing an audio waveform, comprising:

a memory operative to hold at least one coefficient of each of impulse response filters defined in spherical coordinates, said impulse response filters corresponding to head-related transfer functions for a first four-dimensional spatial point and a second four-dimensional spatial point, wherein a similarity exists between the first and second four-dimensional points;

a processor operative to apply first and second impulse response filters corresponding to the first and second spatial points to first and second segments of the audio waveform to yield first and second spatialized waveforms and to extrapolate data both forward from an end portion of the first spatialized waveform and backward from a beginning portion of the second spatialized waveform to create a fully spatialized waveform for a path between the first and second spatial points, wherein the path varies with at least two dimensions of the first and second spatial points; and a storage device operative to store said spatialized waveform in a computer-readable format.

12. The apparatus of claim 11, further comprising an input device operative to receive said dichotic waveform and communicate the dichotic waveform to the memory.

13. The apparatus of claim 12, further comprising a playback device operative to play said spatialized waveform through at least two speakers to emulate at least one acoustic property of said dichotic waveform emanating along the path between said first and second four-dimensional spatial points.

14. The apparatus of claim 12, wherein said at least one acoustic property is chosen from the group comprising amplitude, phase, inter-aural time delay, and color.

15. The apparatus of claim 12, wherein said input device is a dummy head.

16. The apparatus of claim 13, wherein said playback device is a compact disc player.

17. The apparatus of claim 11, wherein said processor comprises first and second G5 processors.

18. The apparatus of claim 11, wherein said storage device is a compact disc.

19. The apparatus of claim 11, wherein said storage device is a magnetic storage device.

20. The method of claim 11, wherein the at least two dimensions include the time dimension.

21. A method for spatializing an input audio waveform to create a spatialized waveform comprising at least one spatialized segment, comprising:

receiving said input audio waveform;

digitizing said input audio waveform; and transforming first and second segments of said digitized input audio waveform into first and second spatialized segments by applying first and second impulse response filters corresponding to first and second spatial points to first and second segments of said digitized input audio waveform;

extrapolating data both forward from an end portion of the first spatialized waveform and backward from a beginning portion of the second spatialized waveform to create a fully spatialized waveform for a path between the first and second spatial points;

storing the spatialized waveform on a physical storage as a digital file operable to be played by a computing device; wherein said first and second impulse response filters correspond to first and second head-related transfer functions modeled in spatial coordinates for the first spatial point and the second spatial point, wherein a similarity exists between the first and second spatial point, wherein the first head-related transfer function corresponds to the first spatial point and the second head-related transfer function corresponds to the second spatial point; and said fully spatialized waveform emulates at least one acoustic characteristic of said input audio waveform emanating along the path between the first and second spatial point, wherein the path varies with at least two dimensions dimension of the first and second points.

22. The method of claim 21, further comprising:

equalizing a first spatialized segment of said spatialized waveform to create a first equalized segment for playback across a first speaker set; and equalizing a second spatialized segment of said spatialized waveform to create a second equalized segment for playback across a second speaker set.

23. The method of claim 22, wherein:

said first speaker set comprises a first left speaker and first right speaker;

said second speaker set comprises a second left speaker and second right speaker;

said first equalized segment comprises a first equalization level; and said second equalized segment comprises a second equalization level; and said first and second equalization levels are different.

24. The method of claim 23, further comprising:

convolving a portion of said first spatialized segment and a portion of said second spatialized segment to create a transition audio segment; and setting said first and second equalization levels to complement said transition audio segment.

25. The method of claim 24, whereby the transition audio segment is substantially free of discontinuities resulting from spatializing the audio waveform as it moves along the path.

26. The method of claim 21, wherein the at least two dimensions include the time dimension.

* * * * *